US010913175B2

(12) United States Patent
Sugihara et al.

(10) Patent No.: US 10,913,175 B2
(45) Date of Patent: Feb. 9, 2021

(54) CARTRIDGE

(71) Applicant: MAX CO., LTD., Tokyo (JP)

(72) Inventors: Sinpei Sugihara, Tokyo (JP); Toshio Shimizu, Tokyo (JP)

(73) Assignee: MAX CO., LTD., Tokyo (JP)

( * ) Notice: Subject to any disclaimer, the term of this patent is extended or adjusted under 35 U.S.C. 154(b) by 146 days.

(21) Appl. No.: 16/353,389

(22) Filed: Mar. 14, 2019

(65) Prior Publication Data

US 2019/0315013 A1 Oct. 17, 2019

(30) Foreign Application Priority Data

Apr. 17, 2018 (JP) ..... 2018-079474

(51) Int. Cl.

| | |
|---|---|
| ***B27F 7/21*** | (2006.01) |
| ***B27F 7/36*** | (2006.01) |
| ***B27F 7/38*** | (2006.01) |
| *B25C 5/02* | (2006.01) |
| *B25C 5/15* | (2006.01) |

(52) U.S. Cl.

CPC ..... *B27F 7/21* (2013.01); *B27F 7/36* (2013.01); *B27F 7/38* (2013.01); *B25C 5/02* (2013.01); *B25C 5/15* (2013.01)

(58) Field of Classification Search

CPC ..... B25C 5/02; B25C 5/04; B25C 5/15; B27F 7/00; B27F 7/21; B27F 7/38

USPC ..... 227/82, 85, 88, 119, 120, 131, 138, 154, 227/155

See application file for complete search history.

(56) References Cited

U.S. PATENT DOCUMENTS 4,623,082 A * 11/1986 Kurosawa ..... B27F 7/38 206/338
5,150,826 A * 9/1992 Logtens ..... B25C 5/085 227/120
5,794,833 A * 8/1998 Strååt ..... B27F 7/38 227/120

(Continued)

FOREIGN PATENT DOCUMENTS

EP 1 769 888 A1 4/2007
JP 2004209561 A 7/2004

OTHER PUBLICATIONS

European Search Report issued in Application No. 19163185.2, dated Oct. 8, 2019, 5 pages.

*Primary Examiner* — Scott A Smith
(74) *Attorney, Agent, or Firm* — Rothwell, Figg, Ernst & Manbeck, P.C.

(57) ABSTRACT

A cartridge includes a staple support part provided on a front end face. The staple support part includes an inclined surface protruding obliquely from the front end face in a striking direction, and is configured to support a crown portion of the staple with the inclined surface and a pair of leg portions of the staple with side edge portions of the inclined surface. The side edge portion has: a connection portion continuing to the inclined surface and extending from the inclined surface in an opposite direction to a feeding direction of the staple, by a first length; and a leg portion contact portion extending with being folded from a tip end portion of the connection portion in the feeding direction by at least the first length, and configured to support corresponding one of the pair of leg portions from an inner side thereof.

5 Claims, 20 Drawing Sheets

(56) References Cited

U.S. PATENT DOCUMENTS

| | | | | |
|---|---|---|---|---|
| 6,050,471 | A * | 4/2000 | Yagi | B25C 5/1689 227/119 |
| 6,371,352 | B1 * | 4/2002 | Mochizuki | B27F 7/38 227/120 |
| 6,557,744 | B2 * | 5/2003 | Kitamura | B27F 7/38 227/119 |
| 6,715,654 | B2 * | 4/2004 | Sugihara | B27F 7/38 227/109 |
| 6,871,768 | B2 * | 3/2005 | Adams | B27F 7/19 227/109 |
| 6,896,167 | B2 * | 5/2005 | Haramiishi | B27F 7/19 227/131 |
| 6,899,258 | B2 * | 5/2005 | Haramiishi | B27F 7/38 227/120 |
| 7,014,084 | B2 * | 3/2006 | Mochizuki | B27F 7/36 227/1 |
| 7,021,513 | B2 * | 4/2006 | Straat | B27F 7/21 227/83 |
| 7,243,830 | B2 * | 7/2007 | Kitamura | B27F 7/21 227/131 |
| 7,726,535 | B2 * | 6/2010 | Jonsson | B27F 7/38 227/131 |
| 7,900,804 | B2 * | 3/2011 | Hakozaki | B27F 7/21 227/120 |
| 8,251,272 | B2 * | 8/2012 | Sugihara | B27F 7/21 227/87 |
| 2006/0163308 | A1 * | 7/2006 | Kitamura | B27F 7/21 227/82 |
| 2008/0061102 | A1 * | 3/2008 | Hakozaki | B27F 7/38 227/82 |

* cited by examiner

CARTRIDGE

CROSS-REFERENCE TO RELATED APPLICATIONS

This application is based upon and claims the benefit of priority from prior Japanese patent application No. 2018-079474, filed on Apr. 17, 2018, the entire contents of which are incorporated herein by reference.

TECHNICAL FIELD

The present invention relates to a cartridge to be mounted to an electric stapler.

BACKGROUND ART

In the related art, an electric stapler configured to automatically perform binding processing for sheets has been widely used. The electric stapler is used with being incorporated in an image forming apparatus having copy, printing, facsimile and the like functions or in a post-processing apparatus coupled downstream of the image forming apparatus or is used as a single desktop apparatus.

The electric stapler is configured to convey a plurality of linear unformed staples to a striking-out part provided at a front end portion of a cartridge, to form the staples into a substantial U-shape by a forming plate, and to strike the same into sheets (bundle) by a driver plate.

Here, when making the staple penetrate the sheet bundle, a penetration resistance is generated on the staple upon the penetration, and a high load resulting from pressing of the driver plate is applied to the staple. For this reason, a leg portion or a crown portion of the staple may be buckled. This problem becomes prominent when the maximum number of sheets to be bound is large or when thick paper, coat paper or the like is used.

In order to solve the buckling problem of the leg portion or crown portion of the staple, for example, JP-A-2004-209561 discloses a staple leg guide mechanism including a leg support arranged at an inner surface-side of staple legs and a crown support arranged between support pieces of the leg support.

However, according to the technology disclosed in JP-A-2004-209561, since the leg support and the crown support are individually provided, the number of components increases and a structure becomes complicated. When the number of components increases and the structure becomes complicated, the cost increases, too.

An object of the present invention is to provide a cartridge of which the number of components is reduced and a structure is simplified.

SUMMARY OF INVENTION

According to an aspect of the present invention, there is provided a cartridge configured to be mountable to a cartridge mounting part of a stapler main body, the stapler main body comprising: the cartridge mounting part to which the cartridge configured to accommodate therein a plurality of staples can be mounted; a feeding part configured to feed the accommodated staples toward a front end face of the cartridge and to expose at least one staple from the front end face; a forming part configured to bend the staple exposed from the front end face in a direction following the front end face, thereby forming the same into a U-shape including a pair of leg portions and a crown portion connecting end portions of the pair of leg portions; and a striking part configured to move the staple formed into the U-shape in a striking direction in which the staple is bent, thereby striking the staple into sheets placed at an end of the striking part, wherein the cartridge comprises: a staple support part provided on the front end face so as to be located inside the pair of leg portions, the staple support part including an inclined surface protruding obliquely from the front end face in the striking direction and being displaceable in a direction perpendicular to the front end face, the staple support part configured to support the crown portion with the inclined surface and the pair of leg portions with side edge portions of the inclined surface when the staple is moved in the striking direction, and each of the side edge portions has: a connection portion continuing to the inclined surface and extending from the inclined surface in an opposite direction to a feeding direction, in which the feeding part feeds the staple, by a first length; and a leg portion contact portion extending with being folded from a tip end portion of the connection portion in the feeding direction by at least the first length, and configured to support corresponding one of the pair of leg portions from an inner side thereof.

DESCRIPTION OF EMBODIMENTS

Figure 1:
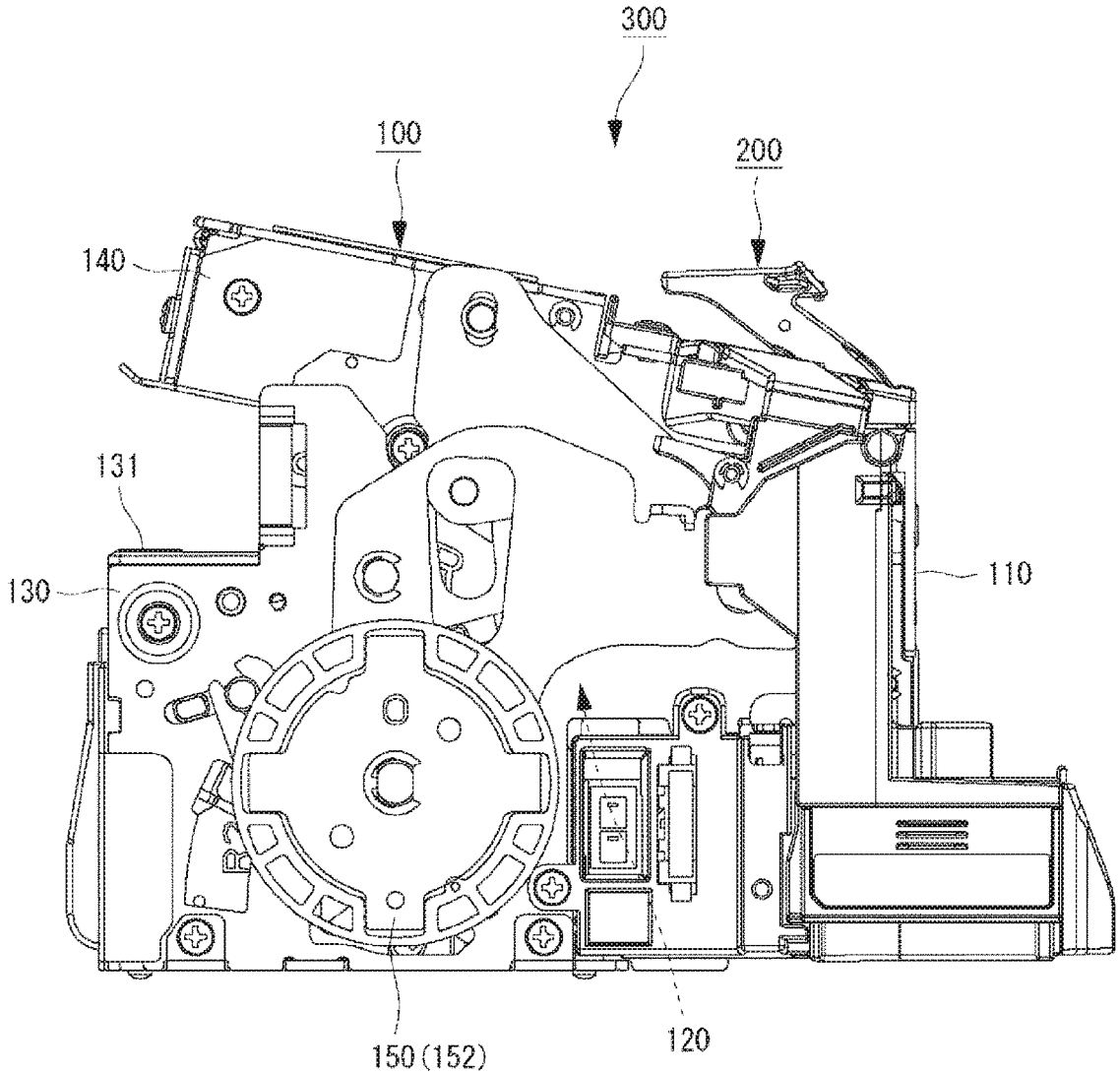
FIG. 1 is a side view depicting an example of an electric stapler according to an exemplary embodiment of the present invention.

Hereinafter, preferred exemplary embodiments of the present invention will be described in detail with reference to the accompanying drawings. In the meantime, the dimensional ratios in the drawings may be exaggerated on account of descriptions and may be different from the actual ratios.

(Configuration Example of Electric Stapler 300)

Figure 2:
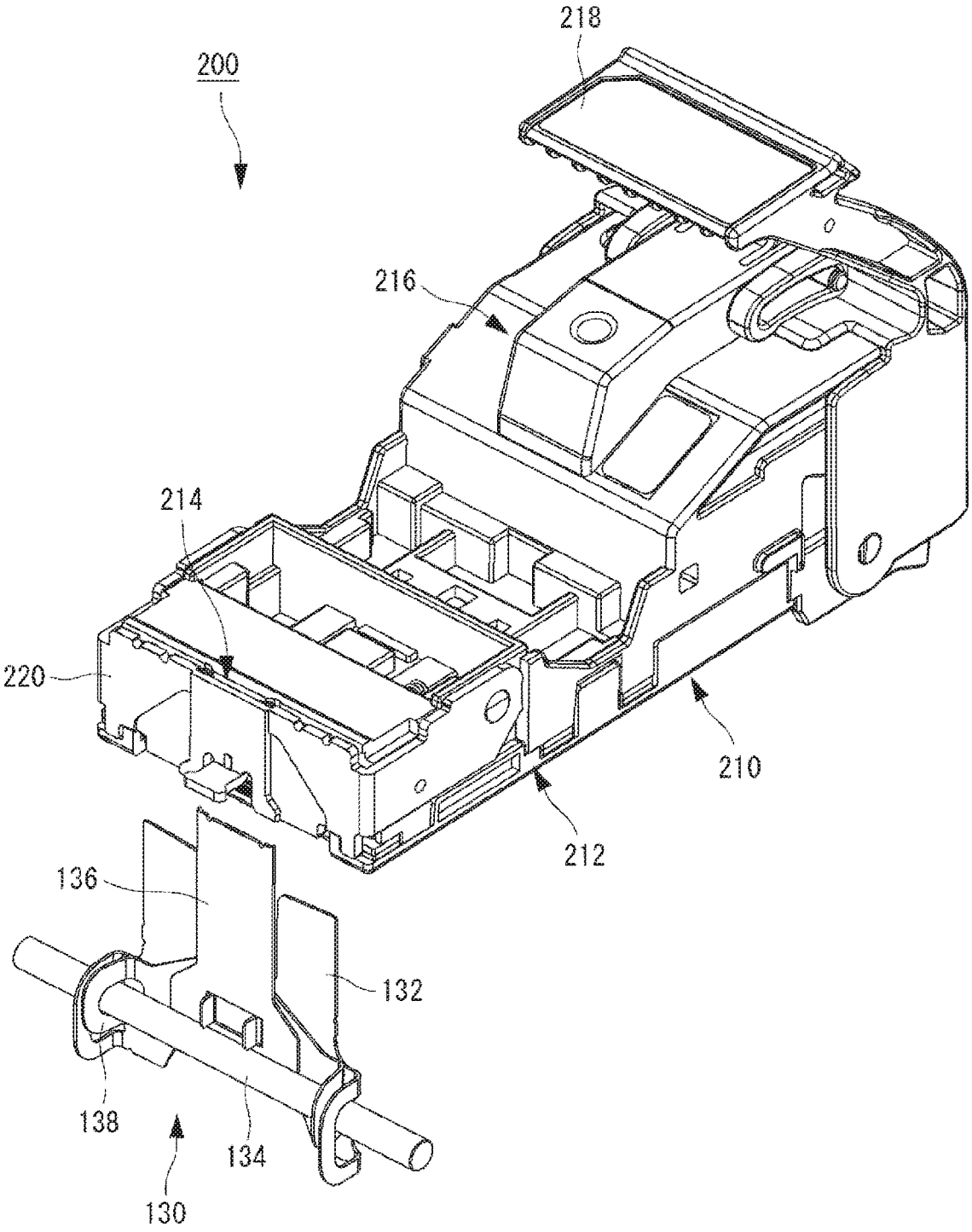
FIG. 2 is a perspective view depicting an example of a cartridge.
Figure 3A:
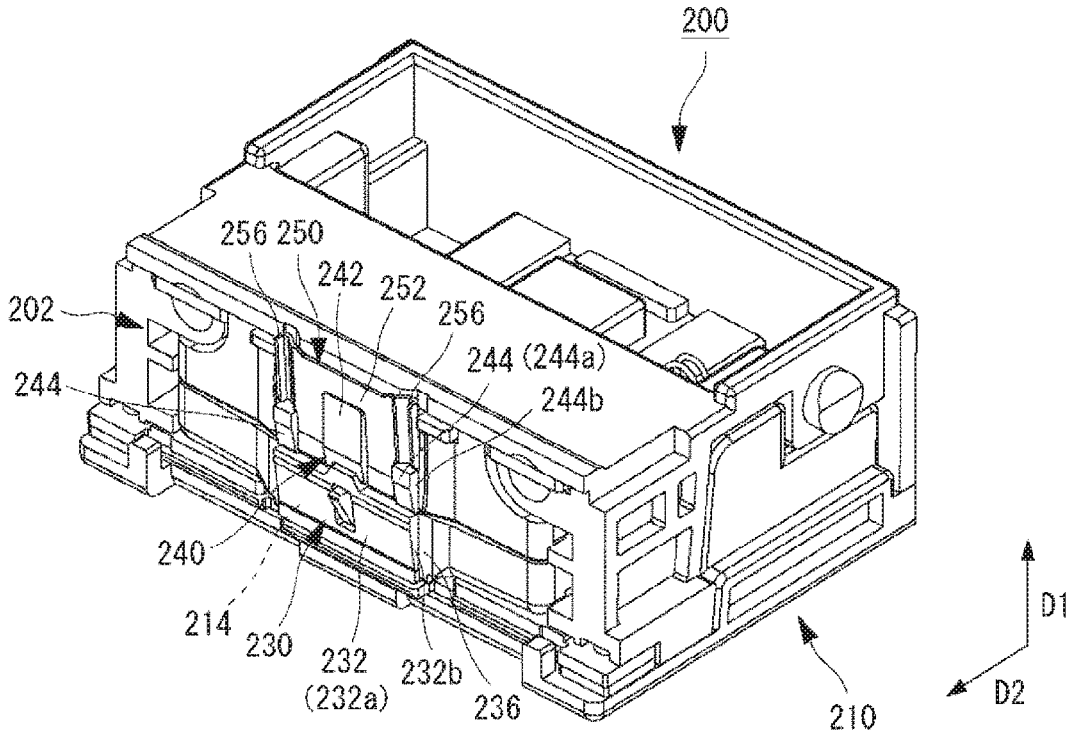
FIG. 3A is a perspective view depicting an example of a front end-side of the cartridge.
Figure 3B:
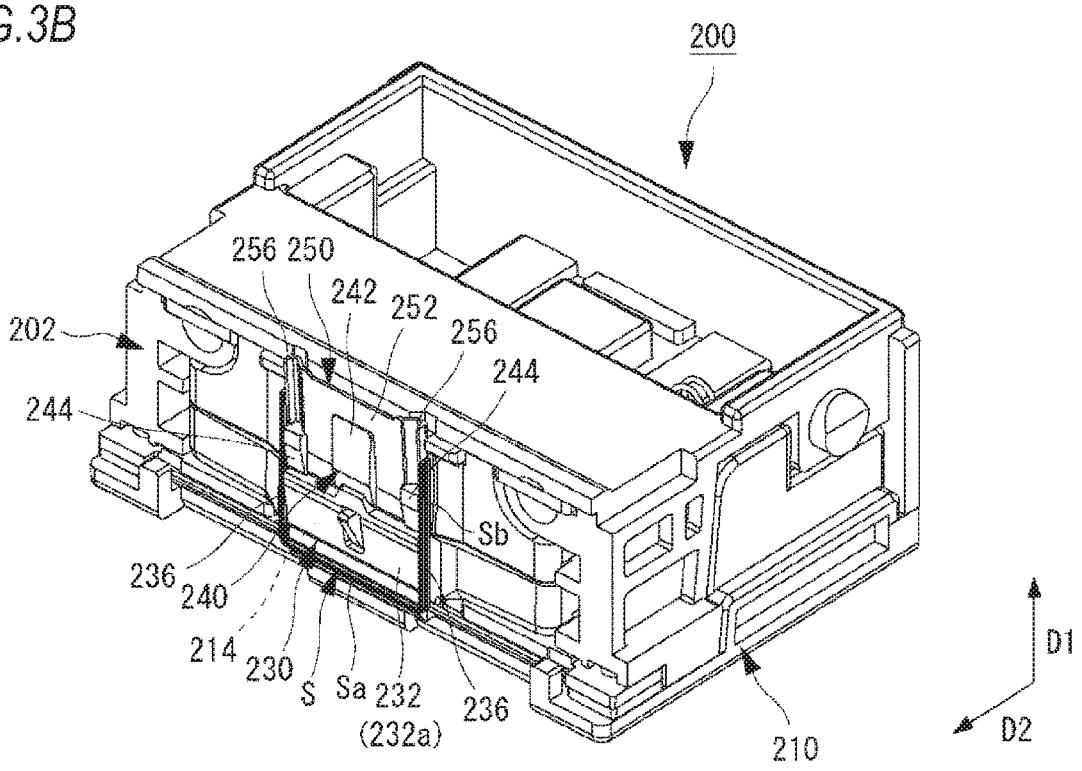
FIG. 3B is a perspective view depicting an example of the front end-side of the cartridge in a state where a substantially U-shaped staple is supplied.

FIG. 1 is a side view depicting an example of an electric stapler 300, FIG. 2 is a perspective view depicting an example of a cartridge 200, and FIGS. 3A and 3B are perspective views depicting an example of a front end-side of the cartridge 200. The electric stapler 300 may be incorporated in an image forming apparatus having copy, printing, facsimile and the like functions or in a post-processing apparatus coupled downstream of the image forming apparatus. Also, the electric stapler 300 may be configured as a single desktop apparatus.

As shown in FIG. 1, the electric stapler 300 includes a stapler main body 100, and a cartridge 200 configured to accommodate therein a plurality of staples. The stapler main body 100 includes a cartridge mounting part 110 to which the cartridge 200 can be mounted, a feeding part 120 configured to feed the staples toward a front end face 202 (refer to FIGS. 2, 3A and 3B) of the cartridge 200, a striking-out part 130 configured to form the staple fed by the feeding part 120 into a substantial U-shape and to strike out the same toward sheets, a binding part 140 configured to bind the sheets by bending leg portions of the staple having penetrated the sheets, and a drive part 150 configured to drive the striking-out part 130, the binding part 140 and the like. An upper surface of the striking-out part 130 facing the binding part 140 is provided with a placement table 131 on which a sheet bundle, which is a target of binding processing, is to be placed.

To the cartridge mounting part 110, the cartridge 200 having coupled staples accommodated therein is detachably mounted. Here, the coupled staple indicates a sheet-shaped staple of which a plurality of linear unformed staples is bonded to each other with being apposed. In the cartridge 200, the coupled staples are accommodated with being stacked.

The feeding part 120 is provided below the cartridge mounting part 110, and is configured to feed the staple accommodated in the cartridge 200 toward the front end face 202 of the cartridge 20X) (a direction of the striking-out part 130) and to expose at least one staple (a staple located at a head of the coupled staples) from the front end face 202.

As shown in FIG. 2, the striking-out part 130 has a forming plate (the forming part) 132 and a driver plate (the striking part) 136. The forming plate 132 is configured to bend an unformed staple S conveyed by the feeding part 120 and exposed from the front end face 202 in a direction following the front end face 202, thereby forming the staple into a substantial U-shape including a pair of leg portions Sb and a crown portion Sa coupling end portions of the pair of leg portions Sb (refer to FIG. 3B). The forming plate 132 is mounted to a forming shaft 134 connected to the drive part 150. The driver plate 136 is configured to move the staple S, which has been formed into the substantial U-shape by the forming plate 132, in a striking direction D1 that is a direction in which the staple S is bent, and to strike the stapler into the sheets placed on the placement table 131. The driver plate 136 is mounted to the forming shaft 134, which is common to the forming plate 132, via a driver guide 138.

The binding part 140 has a cutting part and a clincher part (not shown). The cutting part is configured to cut the leg portions Sb of the staple S having penetrated the sheets into a predetermined length. The clincher part is configured to bend the leg portions Sb of the staple S cut into the predetermined length by the cutting part toward a center-side of the sheets, thereby binding the sheets. In the meantime, the cutting part may not be provided, depending on the maximum number of sheets to be bound by the electric stapler 300.

The drive part 150 includes a gear 152, a cam mechanism and the like, and is configured to drive the feeding part 120, the striking-out part 130 and the binding part 140.

In the above configuration, when the plurality of sheets, which is a binding target, is placed on the placement table 131, the electric stapler 300 drives the drive part 150, thereby rotating the cam and the like by the gear 152. Thereby, the binding part 140 is brought close to the striking-out part 130, thereby clamping the sheets placed on the placement table 131. Then, the striking-out part 130 strikes a first staple S into the sheets by the driver plate 136, and bends a third staple S into a substantial U-shape by the forming plate 132 (at this time, a second staple S has been already bent).

Subsequently, the binding part 140 cuts the leg portions Sb of the staple S having penetrated the sheets into a predetermined length by the cutting part and bends (clinches) the cut leg portions Sb of the staple S by the clincher part. When the clinching is over, the binding part 140 operates in a direction of getting away from the striking-out part 130 and returns to a home position. The series of binding operations are performed during one rotation of the gear 152 of the drive part 150.

(Configuration Example of Cartridge 200)

As shown in FIGS. 2, 3A and 3B, the cartridge 200 includes a cartridge main body 210, an operation part 218, and a face plate 220. The cartridge main body 210 has a front end face 202 and a refill accommodation part 216 arranged at an opposite side (the rear of the cartridge main body 210) to the front end face and provided to accommodate therein a refill (not shown) having the staples S accommodated therein. Also, a staple supply path 212 for feeding the staple S discharged from the refill toward the front end face 202 is formed between the front end face 202 and (a staple discharge port of the refill accommodated in) the refill accommodation part 216. In the meantime, the front end face 202 indicates a plane, which is perpendicular (parallel with the striking direction D1) to a feeding direction D2 of the staple S, of a front end portion of the cartridge main body 210.

The front end face 202 is formed with a staple striking-out path 214 that is continuous from the staple supply path 212 and becomes a movement path of the staple S when the staple S is moved in the striking direction D1. The staple striking-out path 214 is provided between the front end face 202 and a backside of the face plate 220, which will be described later. Also, the front end face 202 is provided with a first pusher 240 protruding from the front end face 202 and configured to press the staple S in the feeding direction (forward) D2, and a second pusher 230 located above the first pusher 240, i.e., upstream of the first pusher 240 in the striking direction D1 of the staple S, protruding from the front end face 202 and configured to press the staple S in the feeding direction (forward) D2 of the staple S.

Also the front end face 202 is provided with a crown support (the staple support part) 250 arranged to overlap a part of the first pusher 240.

The refill accommodation part 216 is provided at a rear side of the cartridge main body 210, and the refill is detachably mounted thereto. In the exemplary embodiment, a plurality of the coupled staples is accommodated with being stacked in the refill. Meanwhile, a roll staple of which long coupled staples are wound into a roll shape may be accommodated in the refill.

The operation part 218 is mounted to an upper part of the cartridge main body 210 so as to be rotatable relative to the cartridge main body 210. When the operation part 218 is pulled backward, the operation part 218 is rotated, so that the cartridge 200 can be taken out from the electric stapler 300.

The face plate 220 is provided at a position facing the front end face 202 so as to cover the front end face 202.

(Configuration Example of Front End-Side of Cartridge 200)

Figure 4:
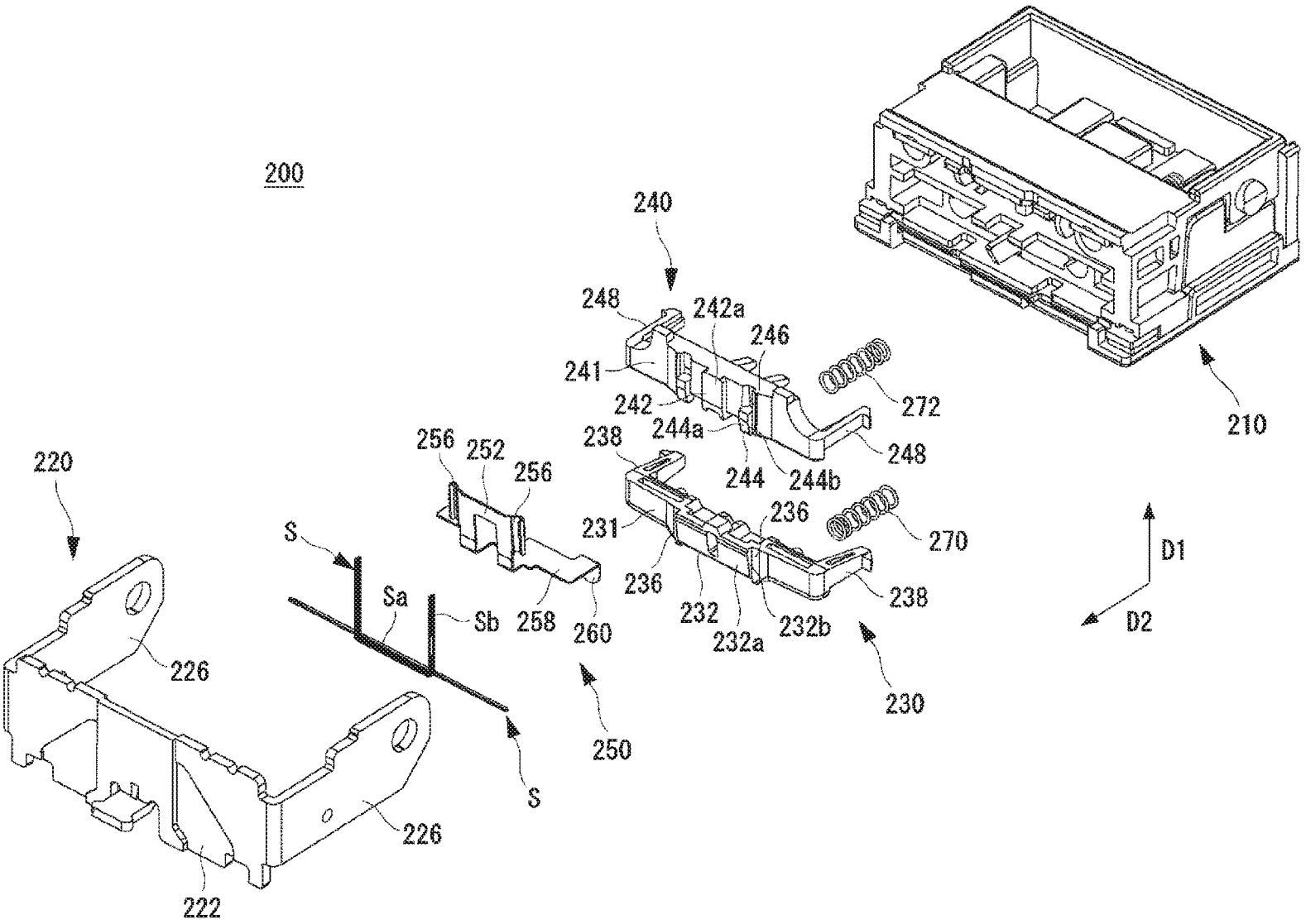
FIG. 4 is an exploded perspective view depicting an example of the front end-side of the cartridge.
Figure 5A:
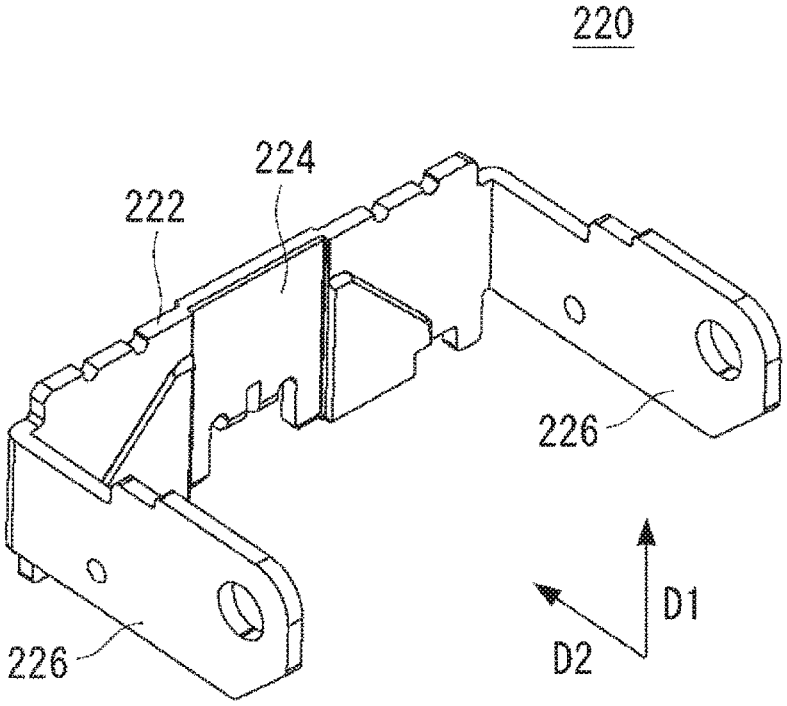
FIG. 5A is a perspective view depicting an example of a face plate.
Figure 5B:
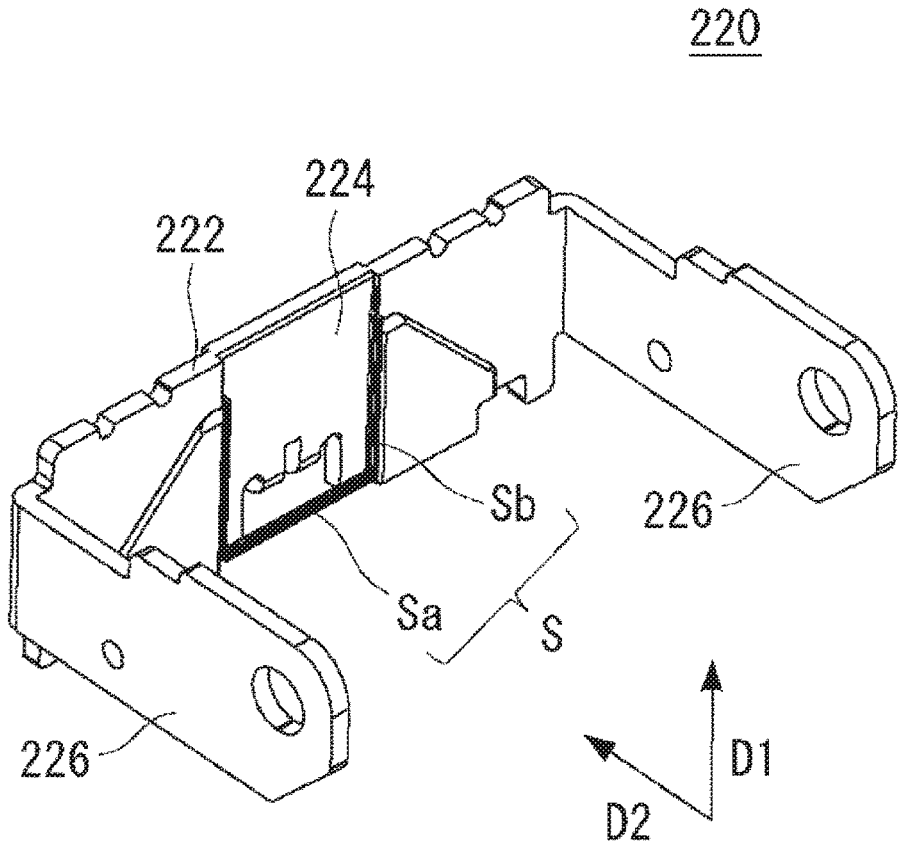
FIG. 5B is a perspective view depicting an example of the face plate in a state where the substantially U-shaped staple is accommodated.
Figure 6A:
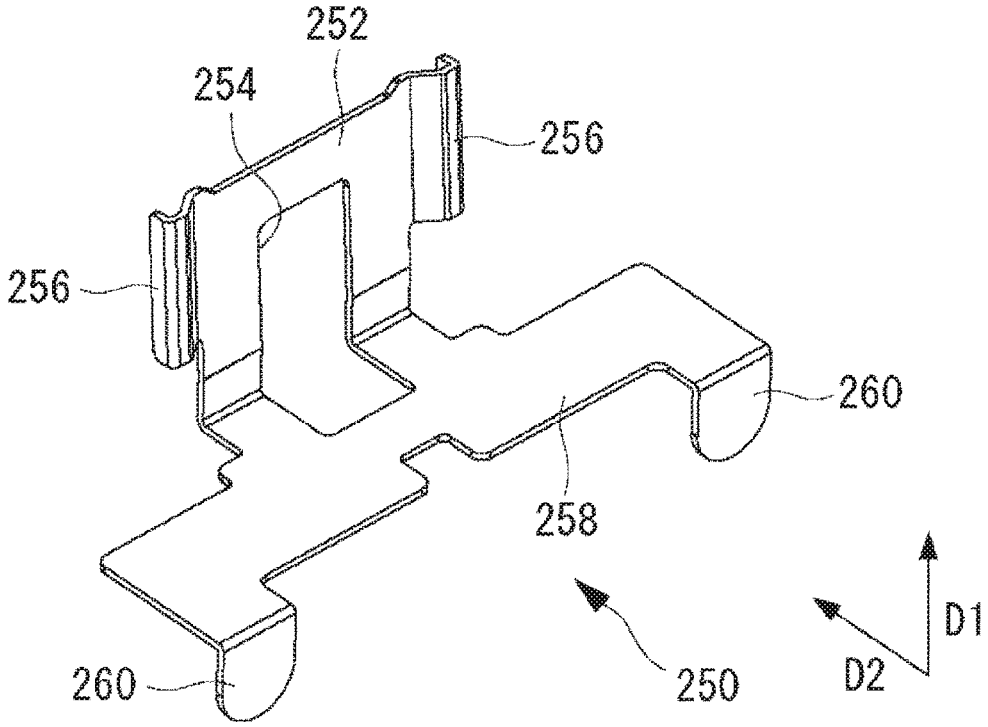
FIG. 6A is a perspective view depicting an example of a crown support.
Figure 6B:
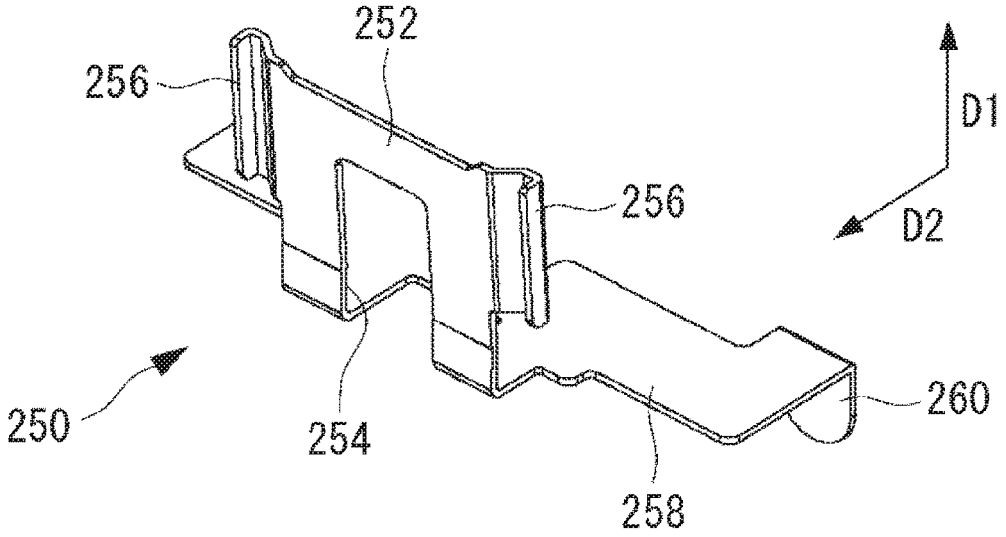
FIG. 6B is a perspective view depicting an example of the crown support.
Figure 6C:
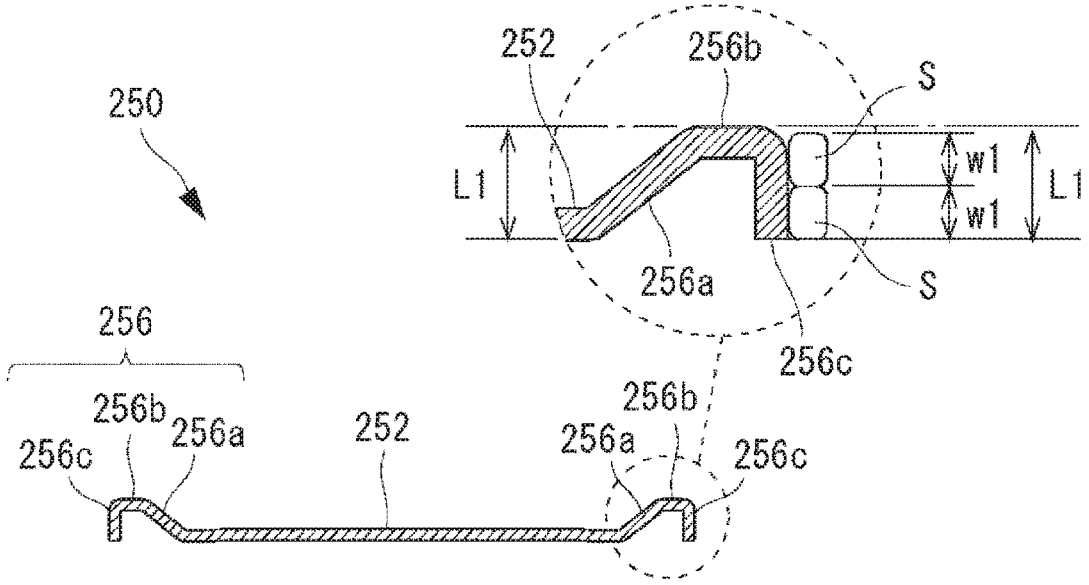
FIG. 6C is a sectional view depicting an example of the crown support.

Subsequently, the face plate 220 provided at the front end-side of the cartridge 200, and the second pusher 230, the first pusher 240 and the crown support 250 provided on the front end face 202 of the cartridge 200 are described in detail. FIG. 4 is an exploded perspective view depicting an example of the front end-side of the cartridge 200, FIGS. 5A and 5B are perspective views depicting an example of the face plate 220, and FIGS. 6A, 6B and 6C are perspective views depicting an example of the crown support 250.

As shown in FIGS. 3A, 3B, 4, 5A and 5B, the face plate 220 has a rectangular plate main body 222, and a pair of attachment parts 226, 226 extending from both end portions of the plate main body 222. In the exemplary embodiment the plate main body 222 and the attachment parts 226, 226 are configured by a single flat plate member such as a plate.

The plate main body 222 is configured to cover the front end face 202 of the cartridge main body 210 and to form the staple striking-out path 214 between the plate main body 222 and the front end face 202.

A rear surface (backside) of the face plate 220 is formed with a step-shaped concave portion 224. In the concave portion 224, the staple S formed into a substantial U-shape is fitted to be slidable in the striking direction D1 by a pressing operation of the first pusher 240, the second pusher 230 and the like. Thereby, the concave portion 224 supports front surfaces of the crown portion Sa and leg portions Sb of the staple S formed into a substantial U-shape and outer surfaces of the leg portions Sb of the staple S.

The attachment parts 226, 226 extend with being bent backward from both left and right end portions of the plate main body 222. The attachment parts 226, 226 are formed at rear end portions with holes for attachment, and are attached to projection-shaped parts to be attached formed on side surfaces of the cartridge main body 210 through the holes for attachment.

As shown in FIG. 4 and the like, the second pusher 230 is urged toward the face plate 220 by springs 270, is attached to protrude from the front end face 202, and has a second pusher main body 231, a guide part 232, pressing parts 236, and attachment parts 238, 238. In the meantime, the springs 270 are arranged to be bilaterally symmetric about a center of the second pusher 230. In FIG. 4, only one spring 270 is shown.

The second pusher main body 231 is formed at a central portion of a front surface with the guide part 232 protruding forward to have a substantially cuboid shape. In the exemplary embodiment, a front surface of the substantial cuboid of the protruding guide part 232 functions as a guide surface 232*a* for crown, and both side surfaces of the substantial cuboid function as guide surfaces 232*b* for leg portion.

The guide surface 232*a* for crown is a surface inclined in a direction of gradually coming close to the face plate 220 along the striking direction D1, based on the front end face 202, and is configured to slidably support a rear surface of the crown portion Sa of the staple S, which is to be struck by the driver plate 136, and an opposite surface to a contact surface to contact with the driver plate 136.

The guide surface 232*b* for leg portion is a surface continuing to a side end portion of the guide surface 232*a* for crown and parallel with the feeding direction D2 (parallel with the coupling direction of the staples S), and is configured to slidably support an inner surface of the leg portion Sb of the staple S, which is to be struck by the driver plate 136.

The pressing part 236 is provided at a position that is continuous to a rear end edge of the guide surface 232*b* for leg portion and faces the rear surface of the leg portion Sb of the staple S. The pressing part 236 is configured to press the rear surface of the leg portion Sb of the staple S toward the face plate 220 (the feeding direction D2) and to slidably support the rear surface of the leg portion Sb of the staple S to be struck by the driver plate 136.

The attachment parts 238, 238 extend with being bent backward from both left and right end portions of the second pusher main body 231. The attachment parts 238, 238 are formed at rear end portions with lock portions for attachment, and are attached to the parts to be attached formed on the side surfaces of the cartridge main body 210 via the lock portions for attachment.

As shown in FIG. 4 and the like, the first pusher 240 is urged toward the face plate 220 by springs 272, and is arranged downstream of the second pusher 230 in the striking direction D1 so as to protrude from the front end face 202 of the cartridge main body 210. The first pusher 240 has a first pusher main body 241, a first guide part 242, and attachment parts 248, 248. In the meantime, the springs 272 are arranged to be bilaterally symmetric about a center of the first pusher 240. In FIG. 4, only one spring 272 is shown.

The first guide part 242 is provided at a position of the first pusher main body 241, which faces the concave portion 224 of the face plate 220. The first guide part 242 protrudes forward in a substantially cuboid shape from a central part of a front surface of the first pusher main body 241. In the exemplary embodiment, a front surface of the first guide part 242 functions as a guide surface 242*a* for crown.

The guide surface 242*a* for crown is inclined in the direction of gradually coming close to the face plate 220 along the striking direction D1, based on the front end face 202, and is configured to slidably support the rear surface of the crown portion Sa of the staple S, which is to be struck by the driver plate 136, and the opposite surface to the contact surface to contact with the driver plate 136. Also, the guide surface 242*a* for crown protrudes (is exposed) forward from an opening of a notched portion 254 (which will be described later) of the crown support 250 toward the face plate 220. Also, the guide surface 242*a* for crown is formed to be longer than a guide surface 244*a* for crown (which will be described later) by a predetermined length at a downstream side in the striking direction D1. Thereby, when the staple S is advanced, the support for the crown portion Sa of the staple S can be continuously taken over from the first pusher 240 to the crown support 250.

Second guide parts 244, 244 are formed at sides, which face the concave portion 224 of the face plate 220, of the first guide part 242 with predetermined intervals from the first guide part 242. The second guide part 244 protrudes forward in a substantially cuboid shape from the first pusher main body 241. In the exemplary embodiment, a front surface of the substantially cuboid second guide part 244 functions as a guide surface 244*a* for crown, and an outer side surface of the substantially cuboid second guide part functions as a guide surface 244*b* for leg portion.

The guide surface 244*a* for crown is inclined in the direction of coming close to the face plate 220 along the striking direction D1, based on the front end face 202, and is configured to slidably support the rear surface of the crown portion Sa of the staple S, which is to be struck by the driver plate 136. The guide surface 244*b* for leg portion is a surface continuing to a side end portion of the guide surface 244*a* for crown and parallel with the feeding direction D2, and is configured to slidably support an inner surface of the leg portion Sb of the staple S to be struck by the driver plate 136.

The pressing part 246 continues to a rear end edge of the guide surface 244*b* for leg portion, and is provided at a position facing the leg portion Sb of the staple S formed into a substantial U-shape. The pressing part 246 is configured to press the rear surface of the leg portion Sb of the staple S toward the face plate 220 (the feeding direction D2) and to slidably support the rear surface of the leg portion Sb of the staple S to be struck by the driver plate 136.

The attachment parts 248, 248 extend with being bent backward from both left and right end portions of the first pusher main body 241. The attachment parts 248, 248 are formed at rear end portions with lock portions for attachment, and are attached to the parts to be attached formed on the side surfaces of the cartridge main body 210 via the lock portions for attachment.

As shown in FIGS. 3A, 3B and 4, the crown support 250 is provided on the front end face 202 of the cartridge main body 210 so as to be located inside the pair of leg portions Sb of the staple S, and is arranged to overlap a part of the first pusher 240 at a downstream side of the second pusher 230 in the striking direction D1. The crown support 250 includes an inclined surface 252 protruding obliquely from the front end face 202 in the striking direction D1. The inclined surface 252 is configured to be displaceable in a direction perpendicular to the front end face 202, i.e., in the feeding direction D2 and in an opposite direction thereof (in a front and rear direction) on the basis of the front end face 202. While the staple S is moved in the striking direction D1, the crown portion Sa is supported by the inclined surface 252, and the leg portions Sb of the staple S are supported by side edge portions 256, 256 of the inclined surface 252. The crown support 250 has a support part 258 extending with being bent in an opposite direction to the feeding direction D2 from a lower end edge (an upstream end edge in the striking direction D1) of the inclined surface 252 and a pair of attachment pieces 260 extending in an opposite direction to the striking direction D1 from both left and right ends of the support part 258. In the exemplary embodiment, the inclined surface 252, the side edge portions 256, 256, the support part 258 and the attachment pieces 260 are integrally formed by a single flat plate member such as a sheet metal.

The inclined surface 252 is a surface inclined in the direction of gradually coming close to the face plate 220 along the striking direction D1, based on the front end face 202, and functions as a plate spring that can be elastically deformed in the opposite direction to the feeding direction D2. The inclined surface 252 is configured to slidably support the rear surface of the crown portion Sa of the staple S, which is to be struck by the driver plate 136, and the opposite surface to a contact surface to contact with the driver plate 136. In the exemplary embodiment, the inclined surface 252 has a width configured to be slightly smaller than a length of the crown portion Sa of the staple S, and is configured to securely support the crown portion Sa of the staple S with a flat surface.

The inclined surface 252 is formed with a rectangular notched portion 254 notched from at least an upstream end edge portion up to a portion in front of a downstream end edge portion in the striking direction D1. In the notched portion 254, the first guide part 242 of the first pusher 240 is inserted, and the first guide part 242 protrudes from the inclined surface 252 toward the face plate 220 (refer to FIG. 3A). Meanwhile, in the exemplary embodiment, the notched portion 254 is formed continuously over the support part 258, which will be described later.

As shown in FIGS. 6A, 6B and 6C, the side edge portions 256, 256 are respectively formed at side end portions of the inclined surface 252 in the right and left direction. The side edge portion 256 has a connection portion 256*a* continuing to a side end portion of the inclined surface 252 and extending in the substantially opposite direction to the feeding direction D2 by a first length L1, a folded portion 256*b* folded from a position of a tip end portion of the connection portion 256*a*, and a leg portion contact portion 256*c* extending from the folded portion 256*b* in the feeding direction D2 by at least the first length L1. The leg portion contact portion 256*c* is configured to slidably support an inner side (inner surface) of the leg portion Sb of the staple S. An end face of the leg portion contact portion 256*c*, which faces the face plate 220, is formed to be flush with the inclined surface 252. Meanwhile, in the exemplary embodiment, the side edge portion 256 has the folded portion 256*b* for interconnecting the connection portion 256*a* and the leg portion contact portion 256*c*. However, the folded portion 256*b* is not necessarily required. That is, the tip end portion of the connection portion 256*a* may be directly folded in the feeding direction D2 without the folded portion 256*b*. In this case, the folded portion 256*b* does not substantially exist, so that the side edge portion 256 is configured by the connection portion 256*a* and the leg portion contact portion 256*c*.

Here, as shown in FIG. 6C, the first length L1 indicates a height up to the tip end portion (the folding position) of the connection portion 256*a* extending in a vertical direction from the inclined surface 252. The first length L1 is at least twice as large as a staple width W1 of the staple S. This is to securely support the inner surfaces of the leg portions Sb of the first and second staples S formed into the substantial U-shape. Thereby, it is possible to prevent the leg portions Sb of the first and second staples S from deviating toward the inside. Also, it is considered to form the side edge portion 256 into a simple plate shape, for example, without folding the same. In this case, however, the staple S to be sequentially fed from the staple supply path 212 may be caught at the plate-shaped tip end portion, so that the staple S may not be smoothly fed. However, when the side edge portion 256 is folded, like the exemplary embodiment, the staple is not caught at the tip end portion (folded portion), so that the staple S can be smoothly fed. Meanwhile, in the exemplary embodiment, as shown in FIG. 6C, the side edge portion 256 is folded to have a substantially U-shaped section. However, the shape of the side edge portion 256 is not limited thereto, and a sectional shape thereof may be triangular or rectangular, for example.

The support part 258 extends with being bent, from the upstream end edge portion of the inclined surface 252 in the striking direction D1, in the opposite direction to the feeding direction D2, and a width thereof is larger than the length of the inclined surface 252 in the right and left direction. The support part 258 is sandwiched between the second pusher 230 and the first pusher 240, and is configured to support the inclined surface 252 to the front end face 202 of the cartridge main body 210 in a state where the inclined surface is inclined toward the face plate 220.

The attachment pieces 260, 260 extend with being bent from both left and right end portions of the support part 258 in the opposite direction to the striking direction D1 by a predetermined length. The attachment pieces 260, 260 are urged in the opposite direction to the feeding direction D2 by the springs 270 provided in the second pusher 230 and are thus fixed in the second pusher 230.

(Operation Example of Electric Stapler 300)

Figure 7A:
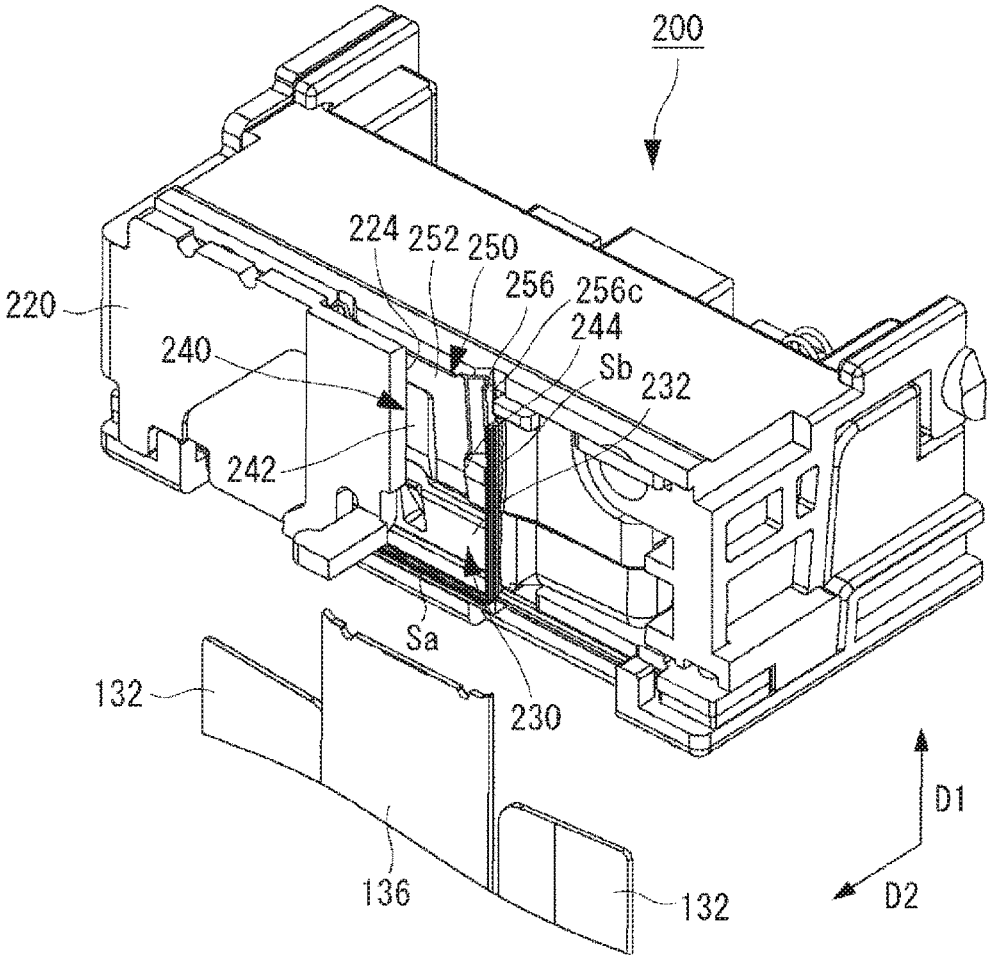
FIG. 7A is a perspective view depicting a front end portion of the cartridge before striking of the staple starts.
Figure 7B:
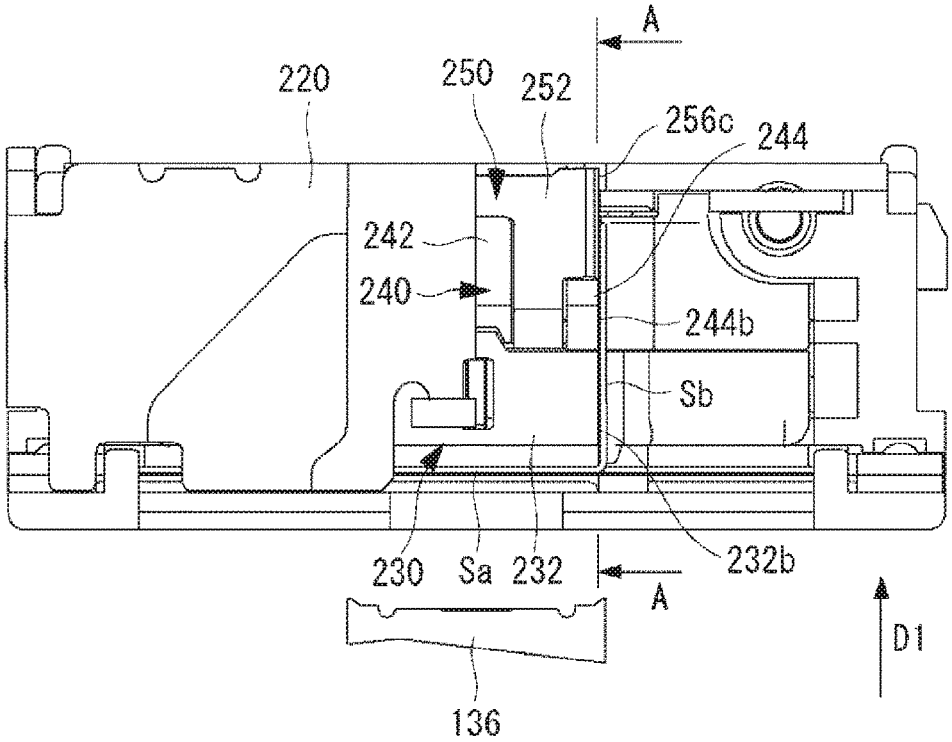
FIG. 7B is a front view depicting the front end portion of the cartridge before striking of the staple starts.
Figure 7C:
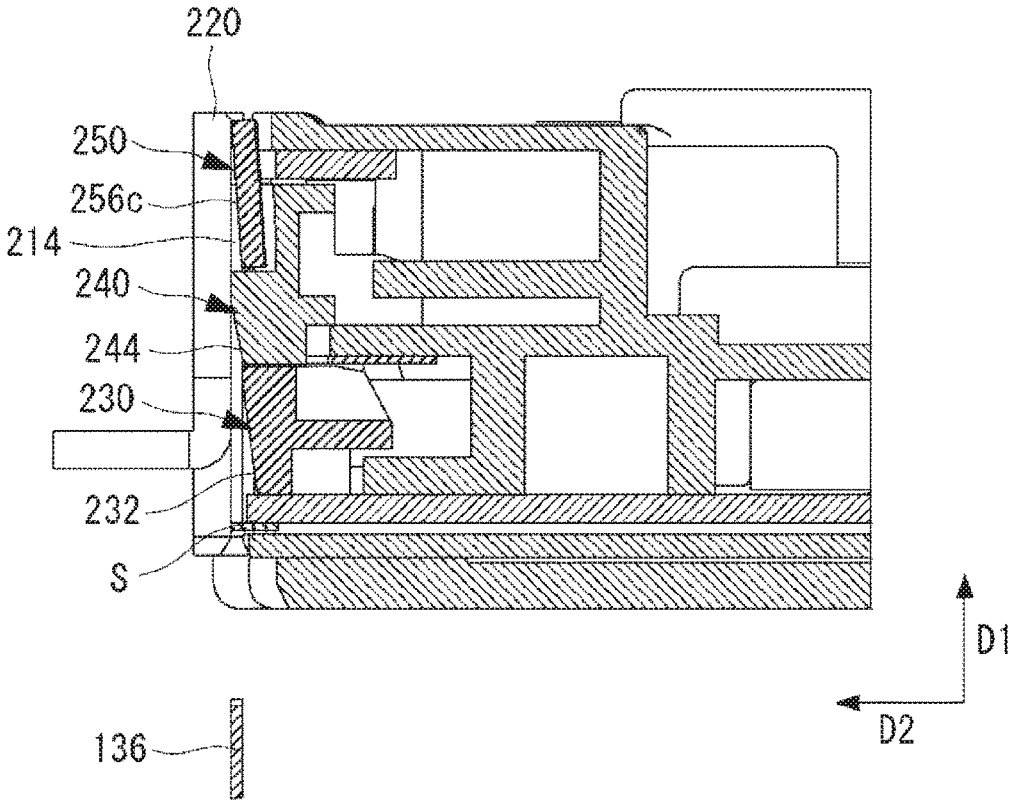
FIG. 7C is a sectional view taken along a line A-A of FIG. 7B.

FIGS. 7A to 7C depict a state of the front end-side of the cartridge 200 before striking of the staple S starts. FIGS. 8A to 8C, 9A to 9C, 10A to 10C and 11A to 11C depict states of the front end-side of the cartridge 200 while the staple S is being struck out the staple S.

As shown in FIGS. 7A to 7C, in a step before striking of the staple S starts, the rear surface of the second staple S is pressed toward the concave portion 224 of the face plate 220 by the second pusher 230 and the first pusher 240. Thereby, the first and second staples S formed into the substantial U-shape are fed into the concave portion 224 of the face plate 220. At this time, the second pusher 230, the first pusher 240 and the crown support 250 enter the inside of the leg portions Sb of the staples S. For this reason, the inner sides of the leg portions Sb of the staples S are supported by the guide surfaces 232*b* for leg portion of the second pusher 230, the guide surfaces 244*b* for leg portion of the first pusher 240 and the leg portion contact portions 256*c* of the crown support 250.

Figure 8A:
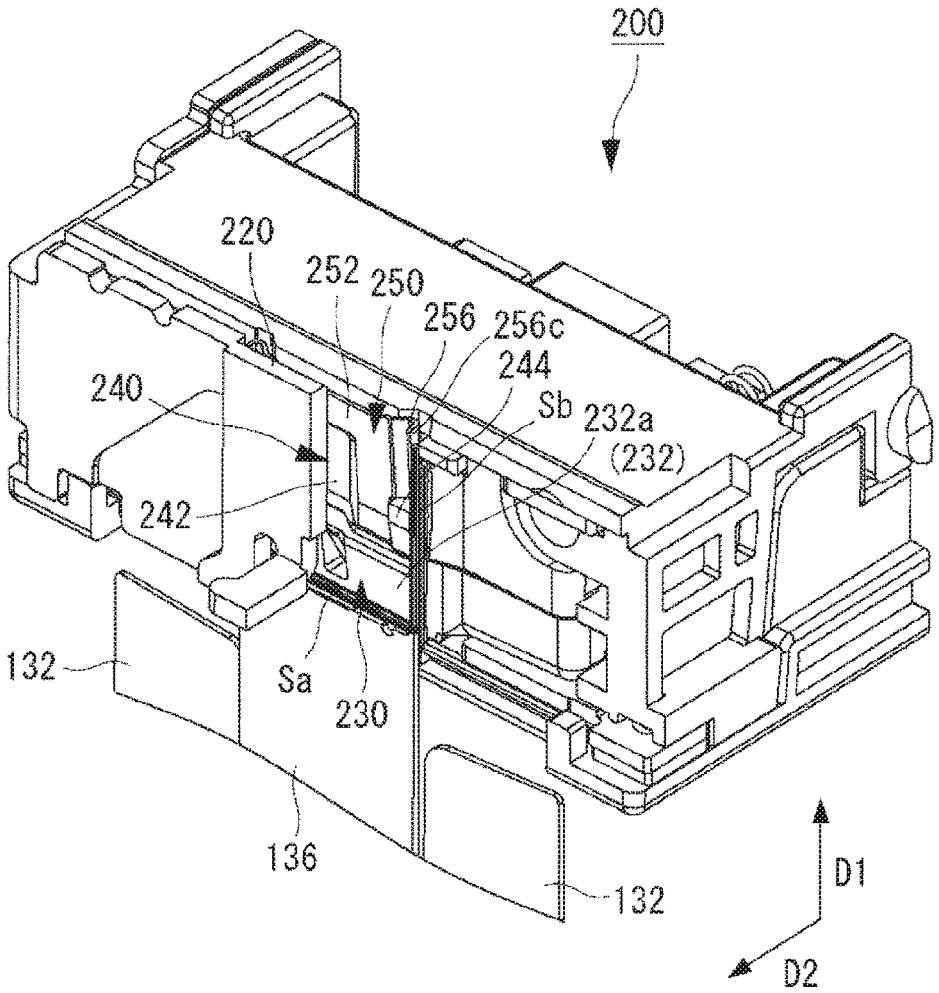
FIG. 8A is a perspective view depicting the front end portion of the cartridge while the staple is being struck out.
Figure 8B:
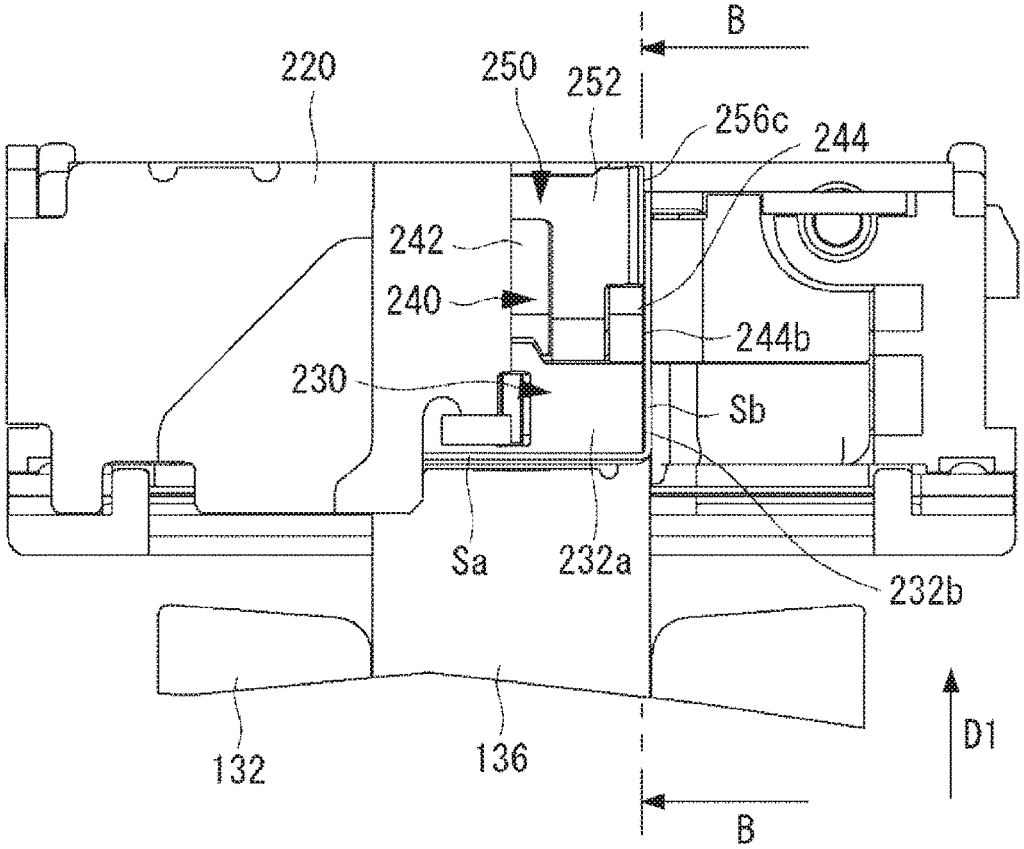
FIG. 8B is a front view depicting the front end portion of the cartridge while the staple is being struck out.
Figure 8C:
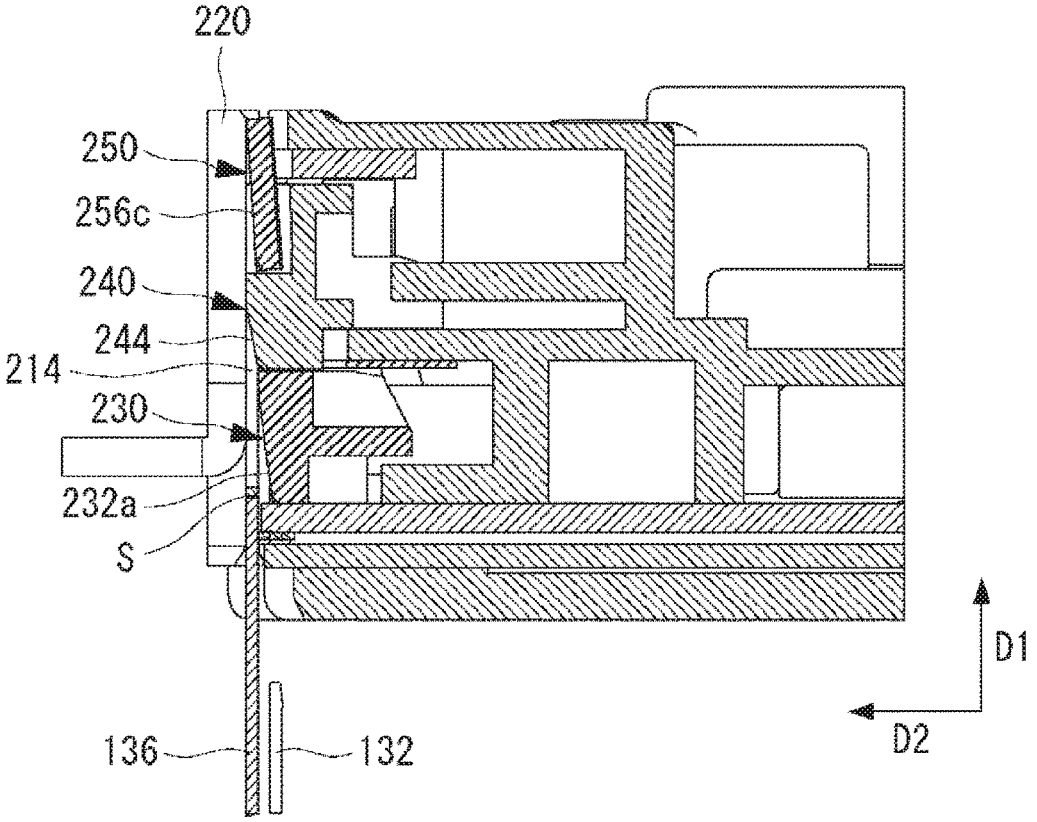
FIG. 8C is a sectional view taken along a line B-B of FIG. 8B.

Then, as shown in FIGS. 8A to 8C, when striking of the staple S starts, the driver plate 136 is advanced along the staple striking-out path 214, thereby pressing the crown portion Sa of the first staple S. Thereby, the first staple S is cut and separated from the second staple S, and the separated staple S is advanced along the staple striking-out path 214. At this time, the rear surface of the crown portion Sa of the staple S and the opposite surface to the contact surface to contact with the driver plate 136 are contacted with and supported to the guide surface 232*a* for crown of the second pusher 230. The inner sides of the leg portions Sb of the staple S are supported by the guide surfaces 232*b* for leg portion of the second pusher 230, the guide surfaces 244*b* for leg portion of the first pusher 240 and the leg portion contact portions 256*c* of the crown support 250.

Figure 9A:
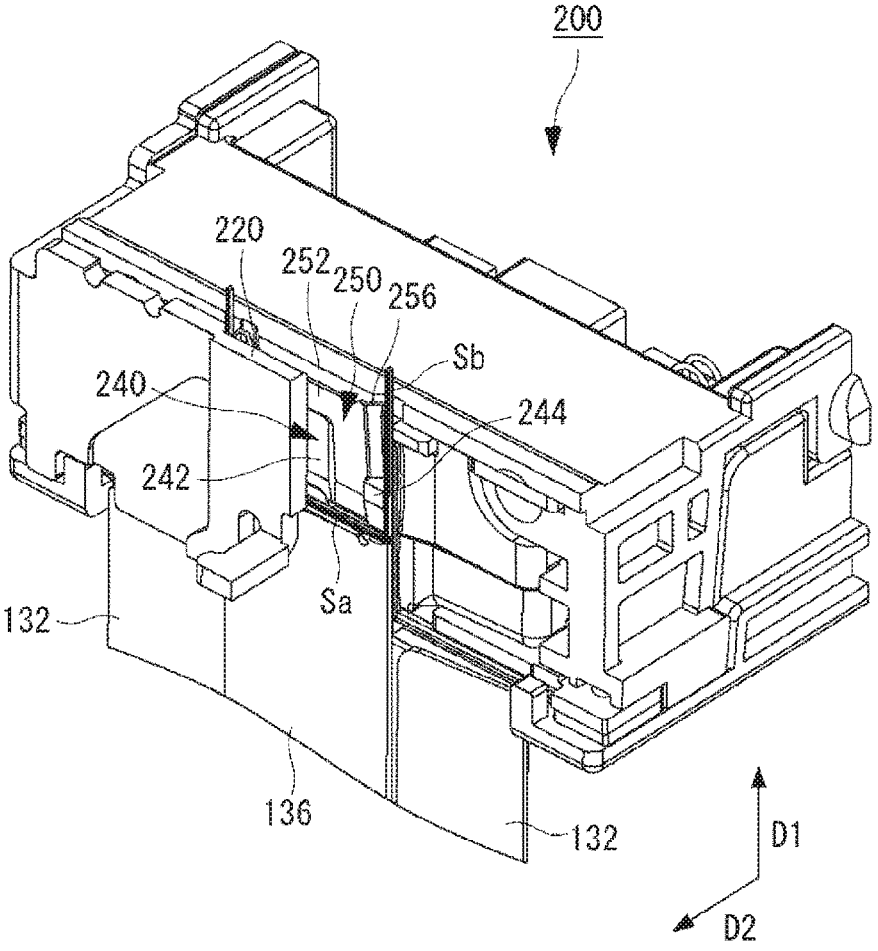
FIG. 9A is a perspective view depicting the front end portion of the cartridge while the staple is being struck out.
Figure 9B:
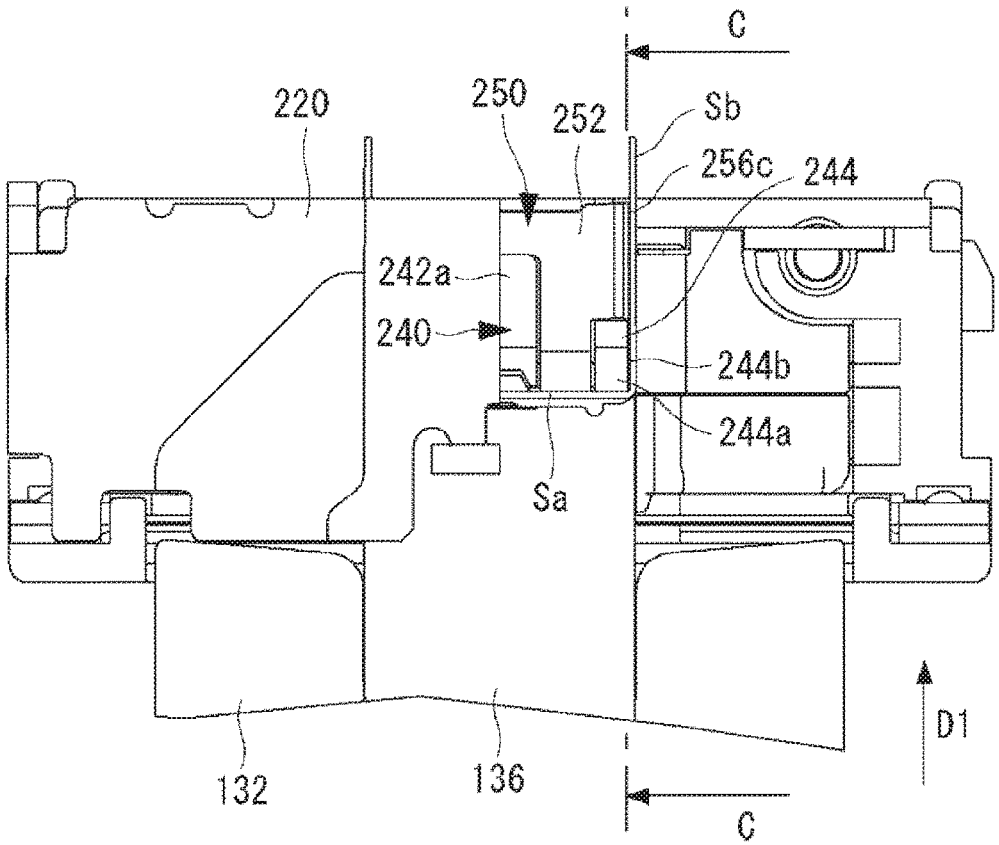
FIG. 9B is a front view depicting the front end portion of the cartridge while the staple is being struck out.
Figure 9C:
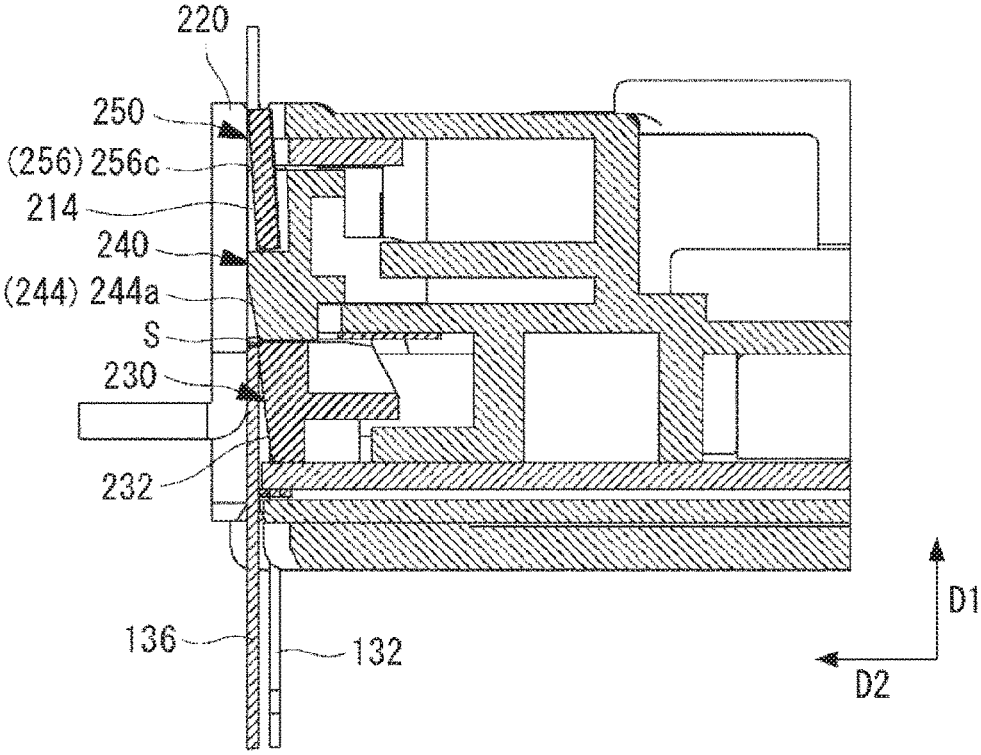
FIG. 9C is a sectional view taken along a line C-C of FIG. 9B.

Then, as shown in FIGS. 9A to 9C, when the staple S is advanced along the staple striking-out path 214 as the driver plate 136 is driven, the crown portion Sa of the staple S rides over the second pusher 230 and contacts with the first pusher 240 located at the downstream side in the striking direction D1. The second pusher 230 is completely retreated by the advancing of the driver plate 136. The rear surface of the crown portion Sa of the staple S and the opposite surface to the contact surface to contact with the driver plate 136 are supported by the guide surface 242*a* for crown of the first guide part 242 and the guide surface 244*a* for crown of the second guide part 244, following the second pusher 230. Also, since the second pusher 230 is completely retreated, the inner sides of the leg portions Sb of the staple S are not supported any more by the guide surfaces 232*b* for leg portion of the second pusher 230 but are subsequently supported by the guide surfaces 244*b* for leg portion of the first pusher 240 and the leg portion contact portions 256*c* of the crown support 250.

Figure 10A:
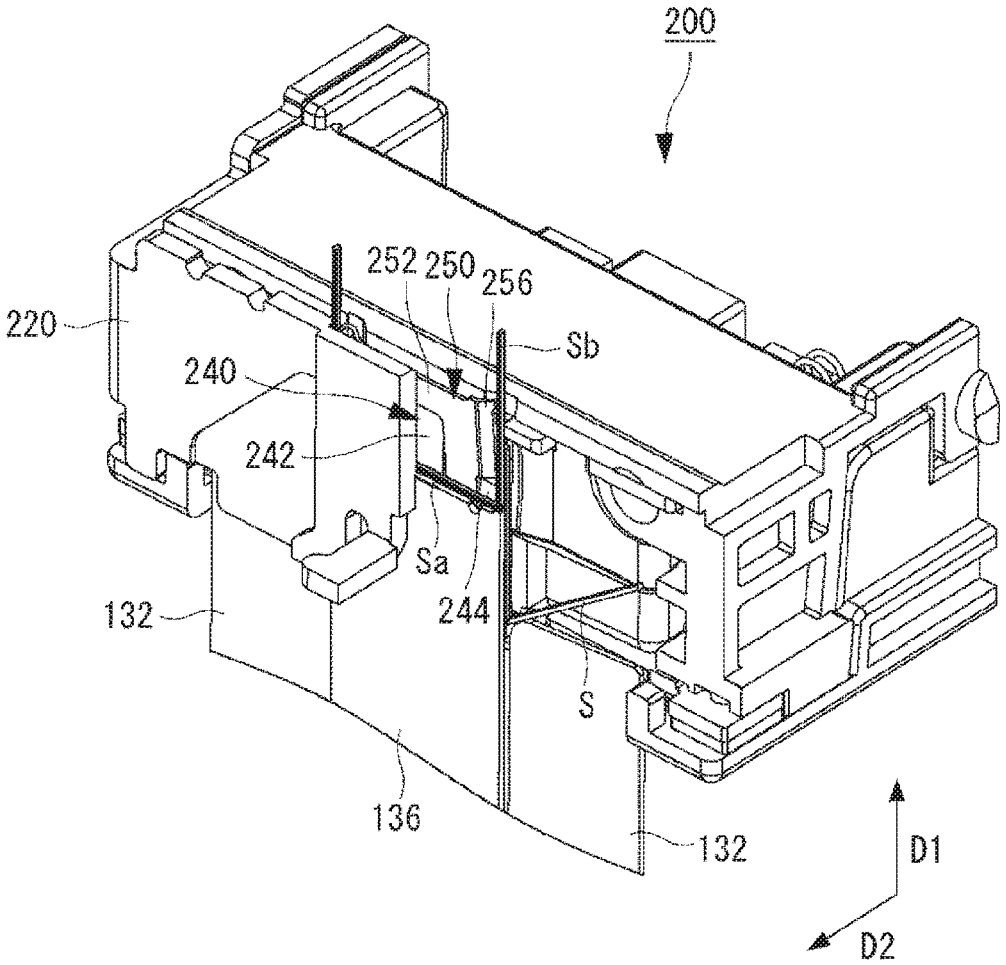
FIG. 10A is a perspective view depicting the front end portion of the cartridge while the staple is being struck out.
Figure 10B:
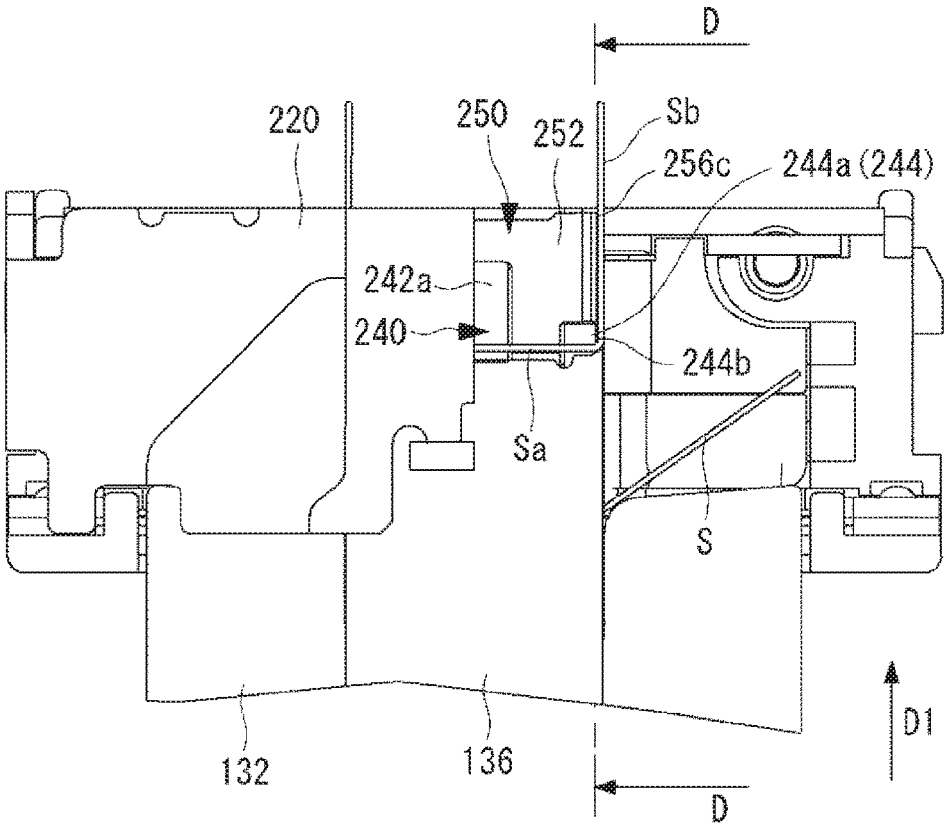
FIG. 10B is a front view depicting the front end portion of the cartridge while the staple is being struck out.
Figure 10C:
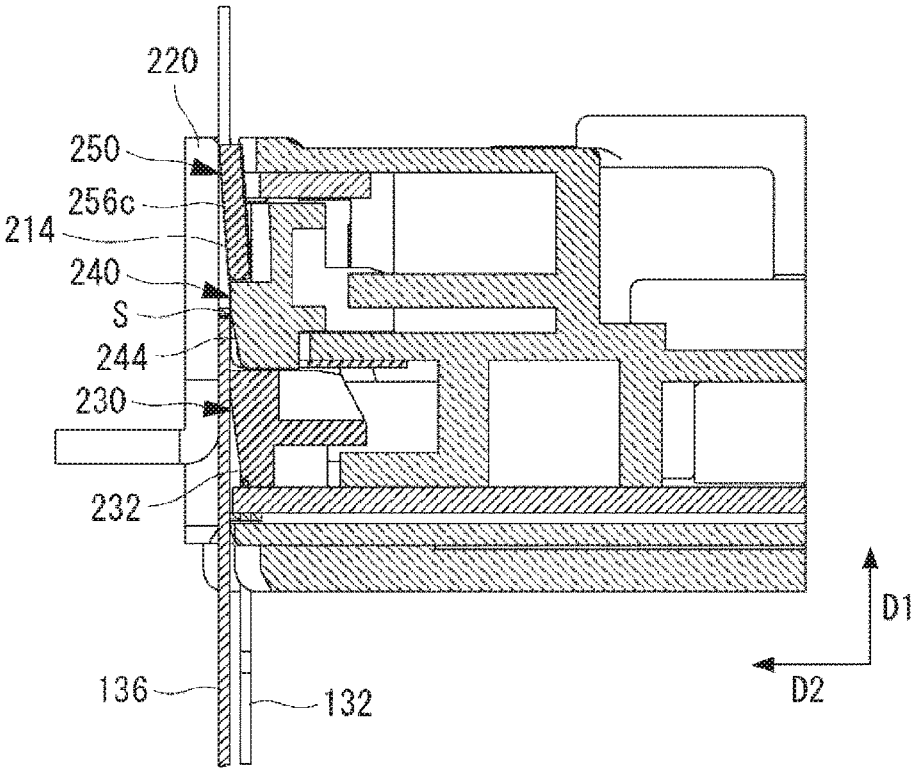
FIG. 10C is a sectional view taken along a line D-D of FIG. 10B.
Figure 11A:
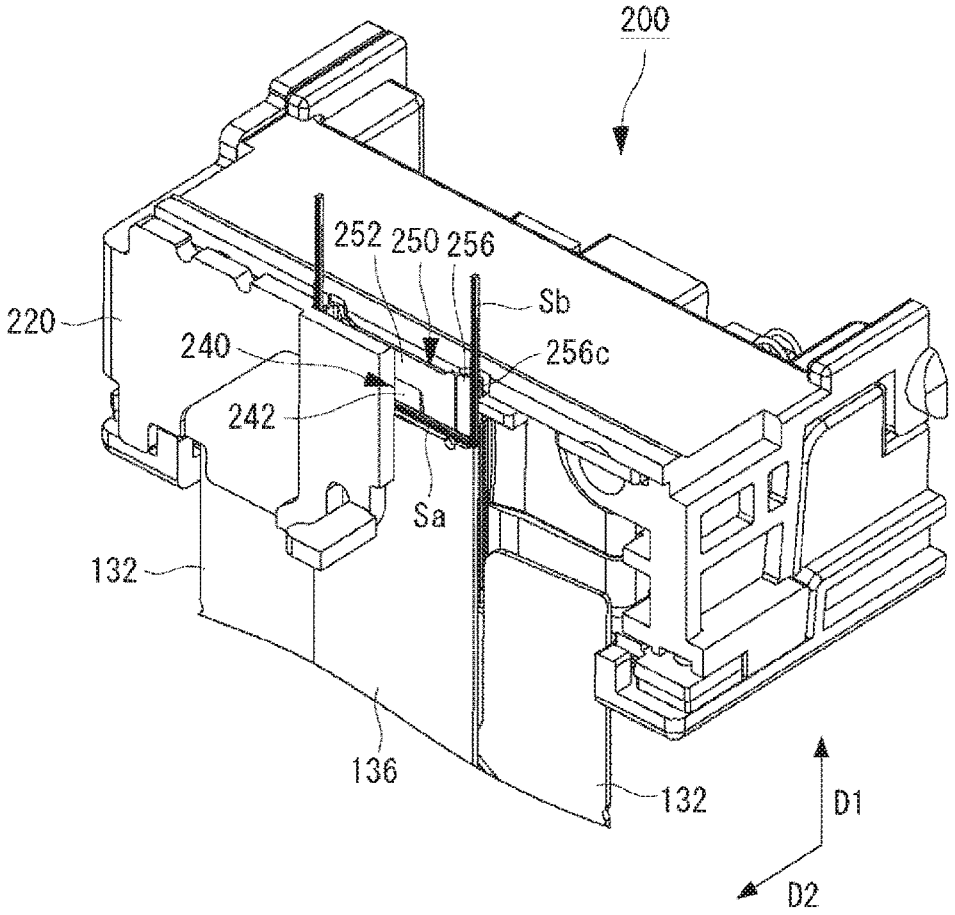
FIG. 11A is a perspective view depicting the front end portion of the cartridge while the staple is being struck out.
Figure 11B:
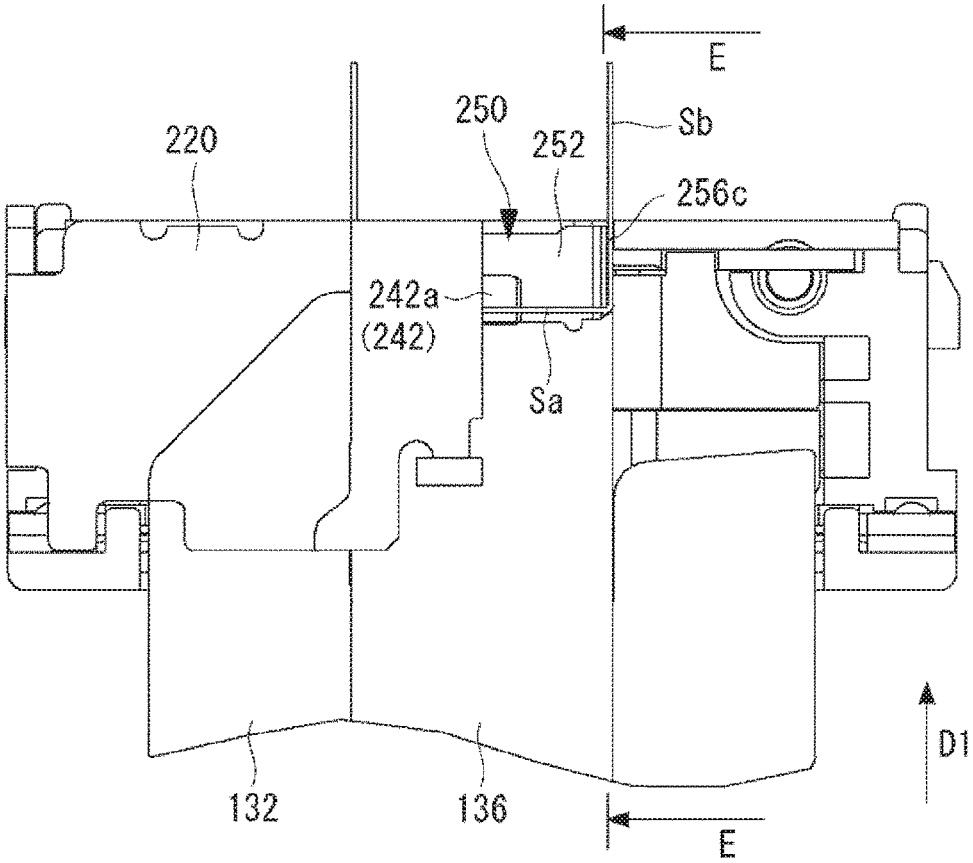
FIG. 11B is a front view depicting the front end portion of the cartridge while the staple is being struck out.
Figure 11C:
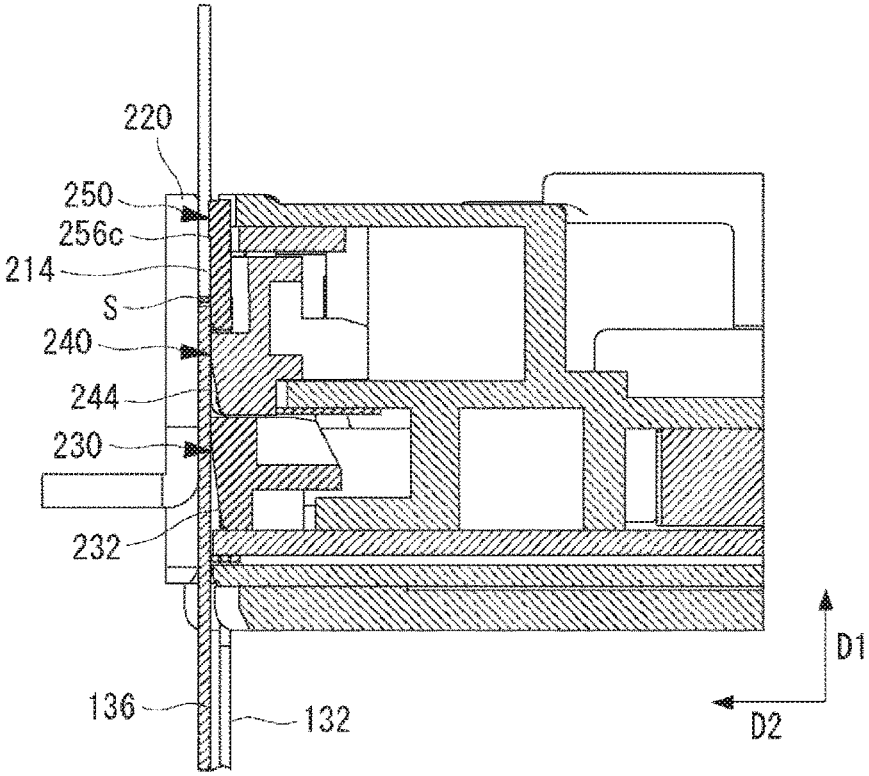
FIG. 11C is a sectional view taken along a line E-E of FIG. 11B.

Then, as shown in FIGS. 10A to 10C, when the driver plate 136 is further advanced along the staple striking-out path 214, the crown portion Sa of the staple S is supported by the first pusher 240. The first pusher 240 is pushed backward by the crown portion Sa of the staple S and is thus retreated. Also in this case, the rear surface of the crown portion Sa of the staple S is supported by the guide surface 242*a* for crown of the first guide part 242 and the guide surface 244*a* for crown of the second guide part 244. Also, the inner sides of the leg portions Sb of the staple S are subsequently supported by the guide surfaces 244*b* for leg portion of the first pusher 240 and the leg portion contact portions 256*c* of the crown support 250. Also, in this step, the forming plate 132 is advanced in the striking direction D1, so that the forming of a third staple S starts.

Finally, as shown in FIGS. 1A to 11C, when the driver plate 136 is further advanced along the staple striking-out path 214, the crown portion Sa of the staple S rides over the guide surface 242*a* for crown of the first guide part 242 and contacts with the inclined surface 252. Accompanied by this, the crown support 250 is elastically deformed backward, so that the crown support 250 is gradually retreated. At this time, the inner sides of the leg portions Sb of the staple S are still supported by the leg portion contact portions 256*c* of the crown support 250. For this reason, the leg portions Sb of the staple S can be prevented from being buckled. Also, when the forming plate 132 is further advanced in the striking direction D1, the forming of the third staple S into a substantial U-shape is completed.

When the striking of the staple S by the driver plate 136 is completed, the driver plate 136 is moved in the opposite direction to the striking direction D1 and is returned to the home position. Also, the staple S formed into a substantial U-shape is extruded to the concave portion 224 of the face plate 220 by the second pusher 230 and the first pusher 240. In the exemplary embodiment, the above binding processing is repetitively performed.

As described above, the crown support 250 of the exemplary embodiment has both the inclined surface 252 configured to support the crown portion Sa of the staple S and the side edge portions 256, 256 configured to support the leg portions Sb of the staple S and both the configurations are implemented by the single component. Therefore, it is possible to reduce the number of components and to thus save the cost. Also, in the crown support 250 of the exemplary embodiment, the side edge portions 256, 256 configured to support the leg portions Sb of the staple S are folded in the feeding direction D2 from the opposite direction to the feeding direction D2. Therefore, it is possible to support the inner sides of the leg portions Sb of the staple S with the surfaces and to smoothly convey the leg portions Sb of the staple S, so that it is possible to prevent a conveying defect of the staple S.

Also, according to the exemplary embodiment, the first length L1 of the leg portion contact portion 256*c* of the crown support 250 is at least twice as large as the staple width W1 of the staple S. Therefore, it is possible to support the inner surfaces of the leg portions Sb of the first and second staples S with the surfaces, so that it is possible to improve the guiding ability for the leg portions Sb. Thereby, when conveying the leg portions Sb of the staple S, it is possible to improve the stability and to thus prevent the buckling.

Also, according to the exemplary embodiment, since the crown support 250 is formed by the sheet metal, it is possible to apply a sufficient resistance (support load) to the crown portion Sa of the staple S passing over the crown support 250 by the elastic force thereof. Also, since the inclined surface 252 is formed as the flat surface having a predetermined width, it is possible to support the crown portion Sa of the staple S over a wide region. As a result, it is possible to effectively prevent the crown portion Sa from being buckled when conveying the staple S.

Also, according to the exemplary embodiment, the crown support 250 is provided with the notched portion 254, and the first guide part 242 of the first pusher 240 protrudes forward from the notched portion 254. Therefore, it is possible to support the crown portion Sa of the staple S in order of the second pusher 230, the second guide part 244 and the first guide part 242 of the first pusher 240, and the crown support 250. That is, it is possible to continuously support the crown portion Sa of the staple S. Thereby, it is possible to suppress occurrence of the conveying defect and the like during the conveying of the staple S.

Further, in the exemplary embodiment, it is possible to support the crown portion Sa and leg portions Sb of the staple S by the three-stage configuration of the second pusher 230, the first pusher 240 and the crown support 250. Therefore, even when the number of sheets to be bound increases to 100 sheets, for example, and the staple S having the long leg portions Sb is used, it is possible to prevent the staple S from being buckled. In addition, since the crown support 250 formed by the sheet metal is arranged downstream (exit) of the staple striking-out path 214 in the striking direction D1, it is possible to suppress wear and deterioration of the crown support 250, and to securely prevent occurrence of jamming in the vicinity of the exit of the staple S.

Figure 12A:
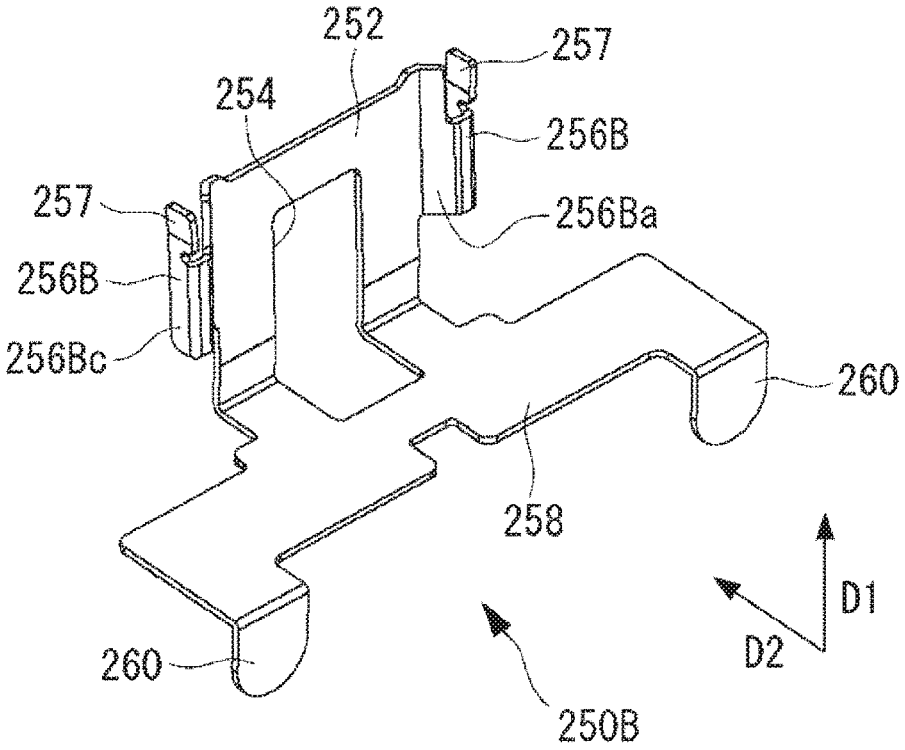
FIG. 12A is a perspective view depicting an example of another crown support.
Figure 12B:
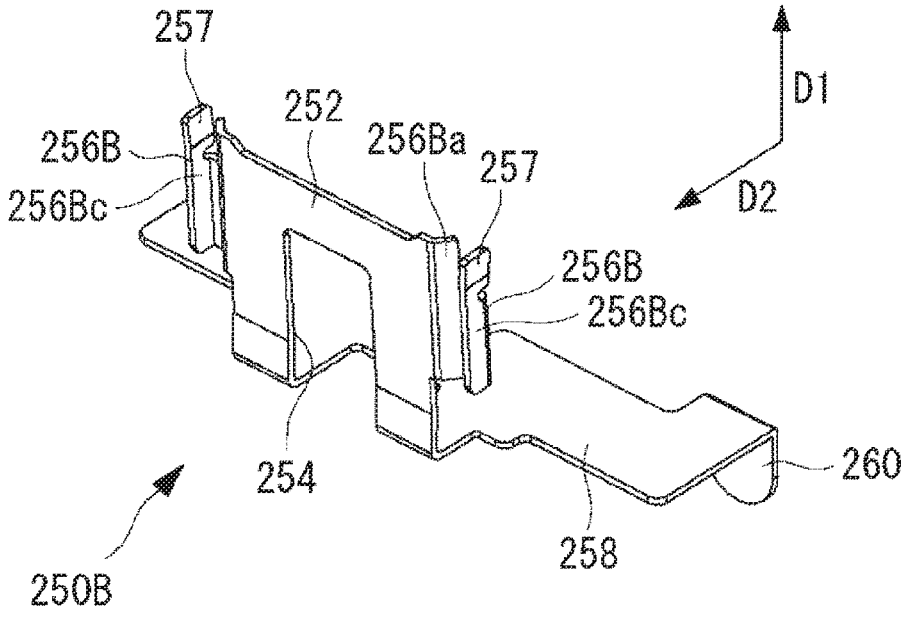
FIG. 12B is a perspective view depicting an example of the another crown support.

Subsequently, modified embodiments of the crown support 250 are described. FIGS. 12A and 12B are perspective views of a crown support 250B. In the meantime, the same configurations as the crown support 250 of the exemplary embodiment are denoted with the same reference numerals, and the detailed descriptions thereof are omitted.

The crown support (staple support part) 250B includes an inclined surface 252 provided on the front end face 202 so as to be located inside the pair of leg portions Sb, protruding obliquely from the front end face 202 in the striking direction D1 and configured to be displaceable in a direction perpendicular to the front end face 202, and supports the crown portion Sa with the inclined surface 252 and the leg portions Sb with side edge portions 256B of the inclined surface 252 when the staple S is moved in the striking direction D1. The side edge portion 256B has a connection portion 256Ba continuing to the inclined surface 252 and extending from the inclined surface 252 in the opposite direction to the feeding direction D2 of the staple S by the first length L1, and a leg portion contact portion 256Bc extending in the feeding direction D2 at least by the first length L1 with being folded from a tip end portion of the connection portion 256Ba and configured to support the leg portion Sb from an inner side thereof.

The leg portion contact portion 256Bc has a side edge elastic portion 257 provided at a downstream end portion in the striking direction D1 and extending obliquely toward the inner surface of the leg portion Sb of the staple S. The side edge elastic portion 257 has elasticity so that it can be displaced relative to the leg portion contact portion 256Bc in the extension direction of the crown portion Sa of the staple S. The crown support 250B is configured to support the inner sides of the leg portions Sb of the staple S by the leg portion contact portions 256Bc and the side edge elastic portions 257. At this time, the leg portions Sb are pressed toward the side surfaces of the step-shaped concave portion 224 of the face plate 220 by the elasticity of the side edge elastic portions 257, so that the leg portions Sb can be supported more strongly. For this reason, it is possible to more favorably guide the staple.

In the meantime, the technical scope of the present invention is not limited to the exemplary embodiment, and the exemplary embodiment can be diversely changed without departing from the gist of the present invention. For example, in the exemplary embodiment, assuming a case where the bundle of 70 to 130 sheets is to be bound, the length of the leg portion Sb of the staple S is set, and the second pusher 230 and the first pusher 240 are provided in correspondence to the length of the leg portion Sb. For example, when binding a bundle of 30 to 70 sheets, since the length of the leg portion Sb of the staple S may be shorter than that of the staple S of the exemplary embodiment, only the downstream pusher 240 may be provided without the upstream pusher 230. Also, the sizes, materials, shapes, relative arrangements and the like of the constitutional components described in the exemplary embodiment are to simply explain the present invention, not to limit the scope of the present invention, unless specifically described.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

According to the cartridge of the present invention, the leg portion contact portion configured to support the leg portion of the staple is continuous to the inclined surface via the connection portion. That is, since the inclined surface configured to support the crown portion of the staple and the side edge portions configured to support the pair of leg portions of the staple are integrally formed, the structure is simple and the number of components can be reduced.

What is claimed is:

1. A cartridge configured to be mountable to a cartridge mounting part of a stapler main body, the stapler main body comprising:

the cartridge mounting part to which the cartridge configured to accommodate therein a plurality of staples can be mounted;

a feeding part configured to feed the accommodated staples toward a front end face of the cartridge and to expose at least one staple from the front end face;

a forming part configured to bend the staple exposed from the front end face in a direction following the front end face, thereby forming the same into a U-shape including a pair of leg portions and a crown portion connecting end portions of the pair of leg portions; and a striking part configured to move the staple formed into the U-shape in a striking direction in which the staple is bent, thereby striking the staple into sheets placed at an end of the striking part, wherein the cartridge comprises:

a staple support part provided on the front end face so as to be located inside the pair of leg portions, the staple support part including an inclined surface protruding obliquely from the front end face in the striking direction and being displaceable in a direction perpendicular to the front end face, the staple support part configured to support the crown portion with the inclined surface and the pair of leg portions with side edge portions of the inclined surface when the staple is moved in the striking direction, and each of the side edge portions has:

a connection portion continuing to the inclined surface and extending from the inclined surface in an opposite direction to a feeding direction, in which the feeding part feeds the staple, by a first length; and a leg portion contact portion extending with being folded from a tip end portion of the connection portion in the feeding direction by at least the first length, and configured to support corresponding one of the pair of leg portions from an inner side thereof.

2. The cartridge according to claim 1, wherein the first length is at least twice as large as a staple width of the staple.

3. The cartridge according to claim 1, further comprising:

a first pusher protruding from the front end face and configured to press the staple in the feeding direction, wherein a part of the inclined surface is formed with a notched portion, and at least a part of the first pusher is configured to protrude from the notched portion.

4. The cartridge according to claim 3, further comprising:

a second pusher provided upstream of the first pusher in the striking direction, the second pusher protruding from the front end face and configured to press the staple in the feeding direction.

5. The cartridge according to claim 1, further comprising:

a face plate provided to cover the front end face and configured to contact with the staple exposed from the front end face.

* * * * *